US012392160B2

(12) United States Patent
Conlon

(10) Patent No.: US 12,392,160 B2
(45) Date of Patent: Aug. 19, 2025

(54) UMBRELLA ANCHORING APPARATUS

(71) Applicant: Derek Conlon, Bronx, NY (US)

(72) Inventor: Derek Conlon, Bronx, NY (US)

( * ) Notice: Subject to any disclaimer, the term of this patent is extended or adjusted under 35 U.S.C. 154(b) by 0 days.

(21) Appl. No.: 18/231,864

(22) Filed: Aug. 9, 2023

(65) Prior Publication Data

US 2023/0392407 A1 Dec. 7, 2023

Related U.S. Application Data

(63) Continuation-in-part of application No. 18/127,152, filed on Mar. 28, 2023, now abandoned, which is a continuation of application No. 17/832,879, filed on Jun. 6, 2022, now abandoned, which is a continuation of application No. 17/122,925, filed on Dec. 15, 2020, now Pat. No. 11,377,866.

(51) Int. Cl.

| | |
|---|---|
| ***E04H 12/00*** | (2006.01) |
| ***A45B 23/00*** | (2006.01) |
| ***A47B 37/04*** | (2006.01) |
| ***E04H 12/22*** | (2006.01) |

(52) U.S. Cl.

CPC ..... *E04H 12/2246* (2013.01); *A45B 23/00* (2013.01); *A47B 37/04* (2013.01); *E04H 12/2269* (2013.01); *A45B 2023/0012* (2013.01); *A45B 2200/1063* (2013.01)

(58) Field of Classification Search

None

See application file for complete search history.

(56) References Cited

U.S. PATENT DOCUMENTS

| | | | | |
|---|---|---|---|---|
| 2,876,974 A * | 3/1959 | Liftman | ..... | E04H 12/2215 248/533 |
| 3,342,444 A | 9/1967 | Nelson | | |
| 3,434,484 A * | 3/1969 | Dilullo | ..... | A45B 17/00 108/6 |
| 4,269,010 A | 5/1981 | Glass | | |

(Continued)

OTHER PUBLICATIONS

Written Opinion of the International Searching Authority for PCT/US2021/036783 established by the ISA/US completed on Sep. 1, 2021.

(Continued)

*Primary Examiner* — Steven M Marsh

(74) *Attorney, Agent, or Firm* — Goldstein Law Offices, P.C.

(57) ABSTRACT

A beach umbrella anchoring and stabilizing device configured to stabilize a beach umbrella on a sandy surface includes an elongated support shaft, an anchoring container, and multiple gussets. The support shaft extends along a longitudinal axis between a proximal end and a distal end and includes a hollow interior configured to receive a beach umbrella support post. An anchoring container is coupled to the distal end and includes an open top with an upper perimeter edge substantially surrounding the support shaft, a closed bottom defining a substantially planar surface, and at least one sidewall extending therebetween. Multiple gussets extend radially between the support shaft and the sidewall. Each of the gussets extends from the closed bottom in a proximal direction parallel to the longitudinal axis.

6 Claims, 25 Drawing Sheets

(56) References Cited

U.S. PATENT DOCUMENTS

| | | | | |
|---|---|---|---|---|
| 4,753,411 | A * | 6/1988 | Lechner | E04H 12/2215 52/165 |
| 5,088,681 | A * | 2/1992 | Procaccianti | E04H 12/2223 52/157 |
| 5,143,108 | A | 9/1992 | Kenney | |
| 5,271,196 | A | 12/1993 | Fanti | |
| 5,636,944 | A | 6/1997 | Buttimore | |
| D388,974 | S | 1/1998 | Piker | |
| 6,443,172 | B2 | 9/2002 | Brumfield | |
| 6,446,649 | B1 | 9/2002 | Bigford | |
| 6,889,953 | B2 | 5/2005 | Harbaugh | |
| 8,783,274 | B1 | 7/2014 | Supino | |
| 9,540,840 | B2 | 1/2017 | Ma | |
| 9,890,551 | B1 | 2/2018 | Delao et al. | |
| 10,344,496 | B1 | 7/2019 | Cefalo | |
| 2002/0036008 | A1 | 3/2002 | Hickam et al. | |
| 2004/0069922 | A1 | 4/2004 | Wu | |
| 2004/0129184 | A1 | 7/2004 | Kraker | |
| 2006/0016950 | A1 | 1/2006 | Bright et al. | |
| 2009/0114795 | A1 | 5/2009 | Giannetto | |
| 2010/0200724 | A1 * | 8/2010 | Kukuk | A45B 25/00 248/530 |
| 2012/0126089 | A1 * | 5/2012 | Silvestri | E04H 12/2269 248/530 |
| 2013/0092199 | A1 | 4/2013 | Berland | |
| 2015/0013734 | A1 | 1/2015 | Krystopher et al. | |
| 2017/0295925 | A1 | 10/2017 | Taylor | |
| 2018/0106062 | A1 | 4/2018 | Brady | |

OTHER PUBLICATIONS

International Preliminary Report on Patentability of the International Preliminary Examining Authority for PCT/US2021/036783 established by the IPEA/US completed on Jan. 24, 2022.

* cited by examiner

UMBRELLA ANCHORING APPARATUS

CROSS REFERENCE TO RELATED APPLICATIONS

The present application is a Continuation-In-Part of U.S. patent application Ser. No. 18/127,152, filed Mar. 28, 2023, which is a Continuation of U.S. patent application Ser. No. 17/832,879, filed Jun. 6, 2022, which is a Continuation of U.S. patent application Ser. No. 17/122,925, filed Dec. 15, 2020 (now issued U.S. Pat. No. 11,377,866), all of which are relied upon and incorporated herein by reference in their entireties. The entire disclosure of any publication or patent document mentioned herein is entirely incorporated by reference.

TECHNICAL FIELD

The present disclosure relates generally to anchoring devices. More particularly, the present disclosure relates to an anchoring device to stabilize a beach umbrella on sand.

BACKGROUND

Beach umbrellas are frequently used by beachgoers to provide an area of shade or shelter to protect them from direct sunrays and provide a somewhat protected area for their various beach items. Conventional beach umbrellas include an elongated, rigid, support post with a pointed lower end including an auger designed to be rotated and driven into the sand by exerting a downward rotational force on the support post. However, horizontal and vertical forces of heavier wind, wind gusts, or subsequent pivotable movement of the umbrella frequently results in the umbrella being completely dislodged from the sand. Indeed, although these augers vertically stabilize the umbrellas by counteracting vertical lifting forces, they do not laterally stabilize the umbrellas from horizontal and angular forces that tend to move the umbrella post laterally, slowly widening the surrounding sand in which the auger has been driven and dislodging it from the sand. This can result in hazardous conditions since the wind, after dislodging the umbrella, will cause the umbrella to roll or tumble along the beach causing an extremely dangerous situation for other beachgoers.

Accordingly, there is a need in the art for an improved beach umbrella anchor which will increase the total static retention forces and the lateral stability of a beach umbrella by alleviating or preventing horizontal or vertical lifting forces, caused by steady winds and/or gusts, from dislodging the beach umbrella from the sand such that a beach umbrella may be used in a more stable, secure, and safe manner.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

According to one aspect of the present disclosure, a beach umbrella anchoring and stabilizing device configured to stabilize a beach umbrella on a sandy surface includes an elongated support shaft, an anchoring container, and multiple gussets. The elongated support shaft extends along a longitudinal axis between a proximal end and a distal end and includes a hollow interior configured to receive a beach umbrella support post. An anchoring container is coupled to the distal end of the elongated support shaft and includes an open top with an upper perimeter edge substantially surrounding at least a portion of the elongated support shaft. The anchoring container further includes a closed bottom defining a substantially planar surface and at least one sidewall extending between the upper perimeter edge and the closed bottom in a direction substantially parallel to the longitudinal axis. Multiple gussets extend radially between the elongated support shaft and the sidewall. Each of the gussets extends from the closed bottom in a proximal direction parallel to the longitudinal axis.

In some embodiments, the proximal end of the elongated support shaft is disposed proximal to the upper perimeter edge of the anchoring container. In some embodiments, the gussets are spaced at equal intervals around the elongated support shaft.

In some embodiments, each of the gussets includes a first side surface, a second side surface, and a top surface. The first side surface and the second side surface may extend between the closed bottom and the top surface. In certain embodiments, the top surface of each gusset is disposed distal to the proximal end of the hollow support shaft and the upper perimeter of the anchoring container. In some embodiments, the top surface is concave between the at least one sidewall and the elongated support shaft. In certain embodiments, each of the gussets includes a depth between the first side surface and the second side surface. The depth may taper from the closed bottom end towards the top surface.

In some embodiments, the beach umbrella anchoring and stabilizing device further includes a reservoir disposed between each of the gussets. The reservoir may be configured to retain a volume of sand. In some embodiments, a portion of the substantially planar surface forms a base of the reservoir.

In certain embodiments, the substantially planar surface includes multiple vaulted portions. Each of the vaulted portions may correspond to each of the gussets. In some embodiments, each of the vaulted portions is configured to accommodate a quantity of sand to anchor the anchoring container relative to the sand. In certain embodiments, the vaulted portions of a first anchoring container are configured to receive the gussets of a second anchoring container when the first anchoring container and the second anchoring container are in a stacked configuration.

According to another aspect of the present disclosure, a beach umbrella anchoring and stabilizing system is presented that includes an elongated support shaft, an anchoring container, a securing element, and a collar. The elongated support shaft extends between a proximal end and a distal end. The proximal end is configured to receive at least a portion of a beach umbrella support post.

The anchoring container includes a center column extending along a longitudinal axis and configured to receive the elongated support shaft therethrough. The anchoring container further includes an open top having an upper perimeter edge circumscribing the center column and a closed bottom defining a substantially planar surface. At least one sidewall extends between the upper perimeter edge and the closed bottom in a direction substantially parallel to the longitudinal axis. Multiple gussets extend radially between the elongated support shaft and the sidewall. Each of the gussets extends from the closed bottom in a proximal direction parallel to the longitudinal axis.

The securing element is configured to couple the center column to the distal end of the elongated support shaft. The collar is coupled to the proximal end of the elongated support shaft and configured to selectively secure a position of the beach umbrella support post relative to the elongated support shaft.

In some embodiments, the distal end of the elongated support shaft includes a threaded connection feature configured to engage a corresponding feature of the securing element.

In some embodiments, the collar is configured to apply pressure to the beach umbrella support post to secure its position. In certain embodiments, the collar includes an inner circumference and an actuator. The actuator may be configured to selectively reduce the inner circumference. In some embodiments, the collar includes opposing pressure elements configured to selectively extend in a perpendicular direction to engage the beach umbrella support post.

In some embodiments, the open top of the anchoring container comprises dimensions greater than dimensions of the closed bottom.

According to a third aspect of the present disclosure, a beach umbrella anchoring and stabilizing device is presented that includes an elongated support shaft, an anchoring container, and a plurality of hollow stabilizing vanes. The elongated support shaft extends along a longitudinal axis between a proximal end and a distal end. The elongated support shaft includes a hollow interior configured to receive at least a portion of a beach umbrella support post.

The anchoring container is coupled to the elongated support shaft. The anchoring container includes an open top, a closed bottom, and at least one sidewall. The open top includes an upper perimeter edge substantially surrounding at least a portion of the elongated support shaft. The closed bottom is proximal to the distal end, and the sidewall extends around the elongated support shaft between the open top and the closed bottom. The sidewall defines a reservoir configured to receive a volume of sand.

Multiple hollow stabilizing vanes extend radially from the elongated support shaft between the closed bottom of the anchoring container and the distal end of the elongated support shaft. Each of the hollow stabilizing vanes defines an interior trough configured to receive a portion of the volume of sand and an exterior surface configured to engage a surrounding volume of sand.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

As discussed above, known beach umbrellas are susceptible to horizontal and angular forces that tend to move the umbrella post laterally, eventually causing the umbrella to dislodge from the sand. This can result in hazardous conditions caused by the umbrella toppling onto beachgoers and/or rolling or tumbling along the beach. The present disclosure addresses these and other issues.

As used herein, the term "distal" refers to a direction away from a canopy of a beach umbrella and towards an end of an umbrella support post engaged in sand and/or a beach. Similarly, the term "proximal" refers to a direction towards the canopy of a beach umbrella and away from the end of the umbrella support post engaged in sand and/or the beach.

Figure 1:
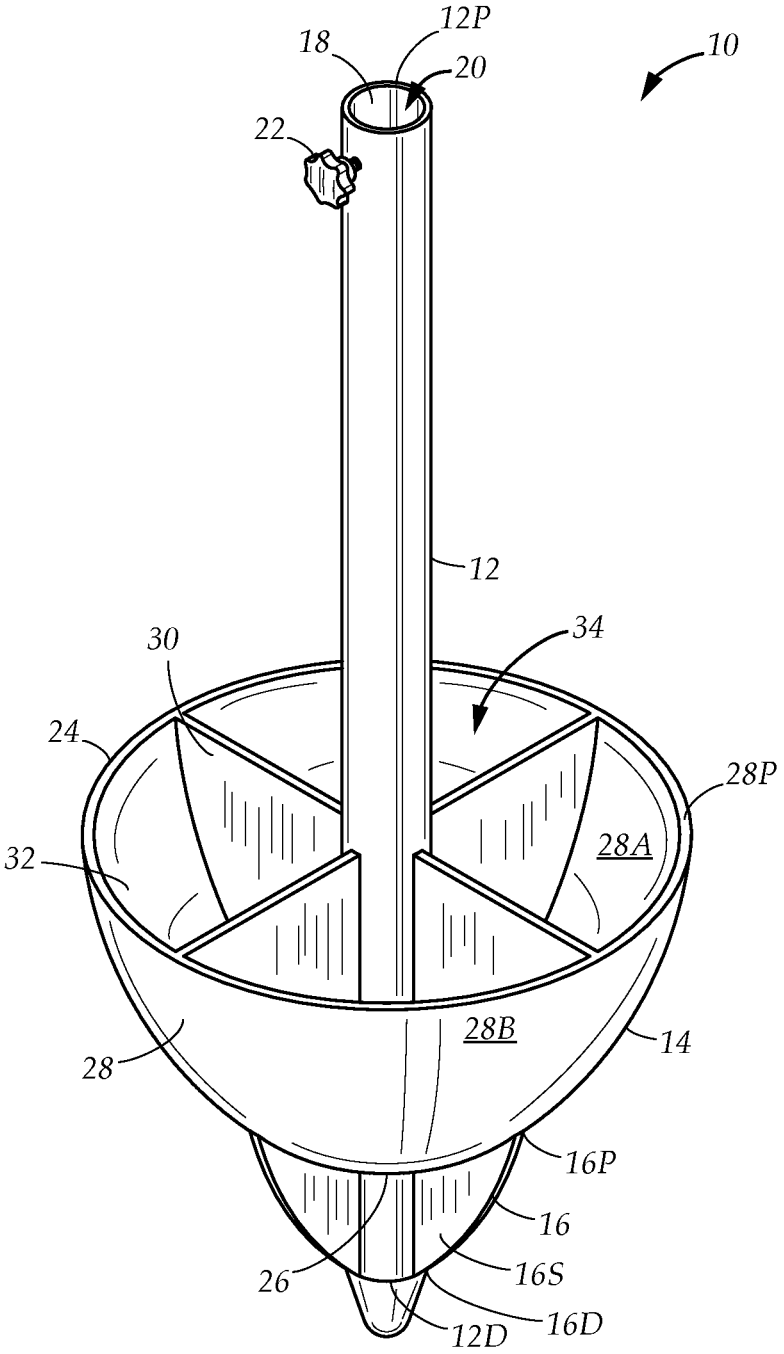
FIG. 1 is a perspective view of the beach umbrella anchoring and stabilizing device according to one embodiment of the present disclosure.

FIG. 1 illustrates a beach umbrella anchoring and stabilizing device 10 comprising an elongated support shaft 12 including a proximal end 12P and a distal end 12D opposite the proximal end 12P, an anchoring container 14 affixed to the support shaft 12, and a plurality of stabilizing vanes 16 affixed to the support shaft 12. In some embodiments, the support shaft 12 includes a hollow interior 18 adapted to receive a beach umbrella support post therein. The proximal end 12P may include an opening 20 providing access to the hollow interior 18. In some embodiments, the proximal end 12P may include a fastener 22 for fastening a beach umbrella support post within the hollow interior 18. The fastener 22 may include, for example, at least one of a screw, a nail, a bolt, a rivet, a grommet, and/or any other suitable fastening device or mechanism.

In some embodiments, the distal end 12D is pointed to facilitate the penetration of sand, such as the sand defining the surface of a beach.

In some embodiments, the anchoring container 14 includes an open top 24, a closed bottom 26 opposite the open top 24, and a sidewall 28 extending around the support shaft 12 from the open top 24 to the closed bottom 26. In certain embodiments, the anchoring container 14 includes a plurality of partitions 30 extending radially inwardly from the sidewall 28 to the support shaft 12. The open top 24 may not be affixed to the support shaft 12 while the closed bottom 26 may be affixed to the support shaft 12 adjacent to the distal end 12D of the support shaft 12.

In some embodiments, the sidewall 28 defines a reservoir 32 extending between the support shaft 12, the open top 24, the closed bottom 26, and the sidewall 28 that is adapted to receive sand. The sidewall 28 may include an inner surface 28A, an outer surface 28B, and an upper perimeter edge 28P defining an opening 34 providing access to the reservoir 32. In some embodiments, the sidewall 28 is annular with respect to the support shaft 12 and tapers in diameter from the open top 24 and upper perimeter edge 28P to the closed bottom 26, thereby forming a concave bowl-shape.

In some embodiments, the partitions 30 define separate and discrete basins within the reservoir 32 that are individually adapted to receive sand. Each of the partitions 30 may extend vertically upwardly or linearly from the closed bottom 26 toward the open top 24. In some embodiments, the partition 30 defines a planar member or structure. In some embodiments, each of the partitions 30 also extends perpendicularly with respect to the support shaft 12. In certain embodiments, each of the partitions 30 extends to the open top 24 such that the partitions 30 are flush with the upper perimeter edge 28P of the sidewall 28. The anchoring container 14 may be adapted to be buried under sand to provide lateral support to the support shaft 12.

Figure 5A:
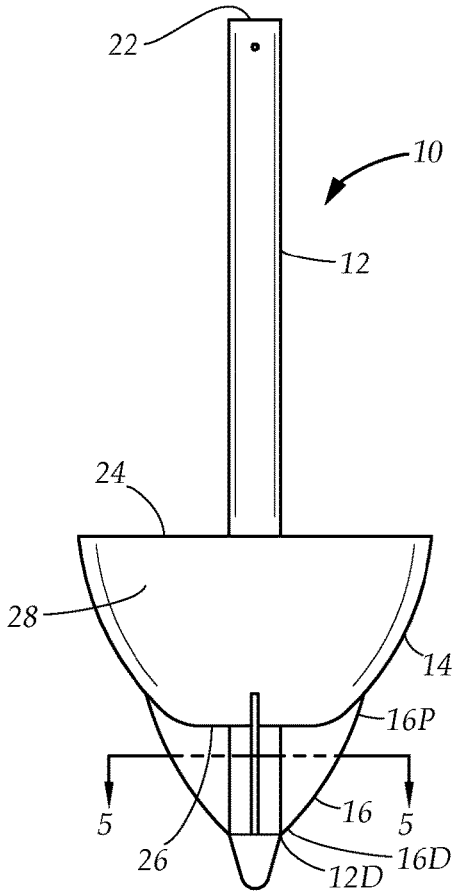
FIG. 5A is a side plan view of the beach umbrella anchoring and stabilizing device according to one embodiment of the present disclosure.
Figure 5:
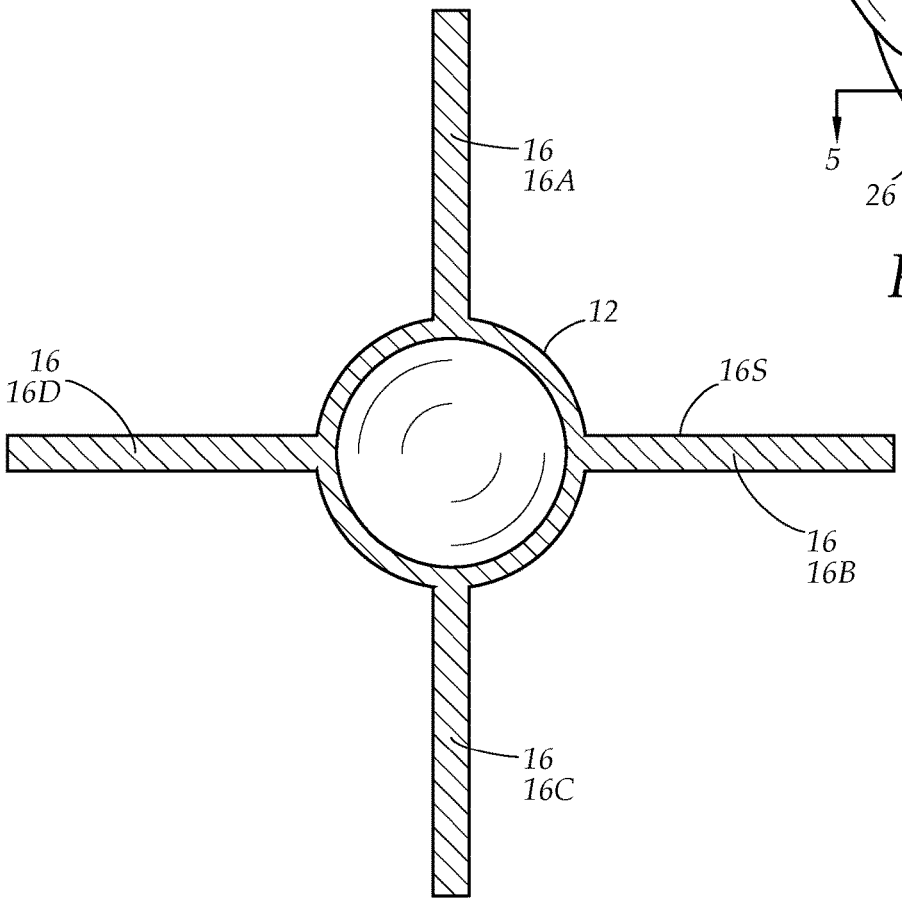
FIG. 5 is a cross-sectional view of the beach umbrella anchoring and stabilizing device across line 5-5 of FIG. 5A, illustrating the configuration of the stabilizing vanes with respect to the support shaft according to one embodiment of the present disclosure.

Referring now to FIG. 5 and FIG. 5A, in conjunction with FIG. 1, the stabilizing vanes 16 may protrude outwardly from the support shaft 12 and may extend from the closed bottom 26 of the anchoring container 14 to the distal end 12D of the support shaft 12. Each of the stabilizing vanes 16 may include a proximal end 16P affixed to the outer surface 28B of the sidewall 28 and a distal end 16D affixed to the distal end 12D of the support shaft 12. In some embodiments, each of the stabilizing vanes 16 taper in width from the proximal end 16P to the distal end 16D such that the stabilizing vanes 16 also taper in width from the closed bottom 26 of the anchoring container 14 toward the distal end 12D of the support shaft 12, thereby defining an arcuate shape.

The stabilizing vanes 16 may be spaced at equal intervals around the support shaft 12 to provide equal support on all sides of the support shaft 12. In some embodiments, each of the stabilizing vanes 16 defines a broad surface 16S adapted to engage sand when a rotational force is exerted onto the support shaft 12. In this way, the stabilizing vanes 16 may prevent rotation of the support shaft 12 about a longitudinal axis of the support shaft 12 when the anchoring container 14 is buried under the sand. In some embodiments, the stabilizing vanes include four stabilizing vanes 16A, 16B, 16C, 16D, each protruding orthogonally outwardly with respect to the support shaft 12. In other embodiments, the stabilizing vanes 16 are aligned with the partitions 30 of the anchoring container 14.

Figure 2:
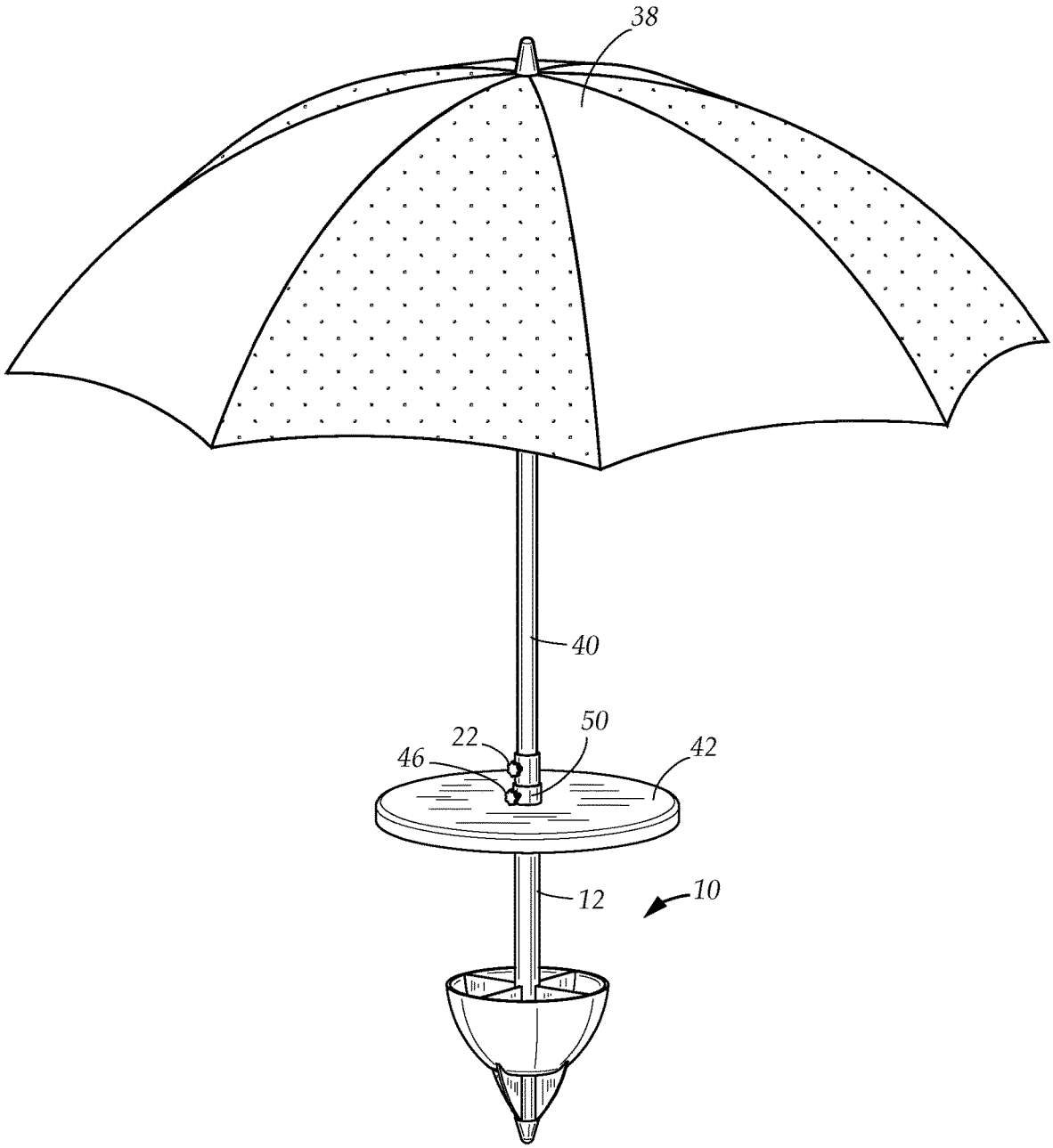
FIG. 2 is a perspective view of the beach umbrella anchoring and stabilizing device, illustrating the beach accessory tray mounted onto the support shaft of the beach umbrella anchoring and stabilizing device and a beach umbrella support post mounted into the support shaft according to one embodiment of the present disclosure.
Figure 3:
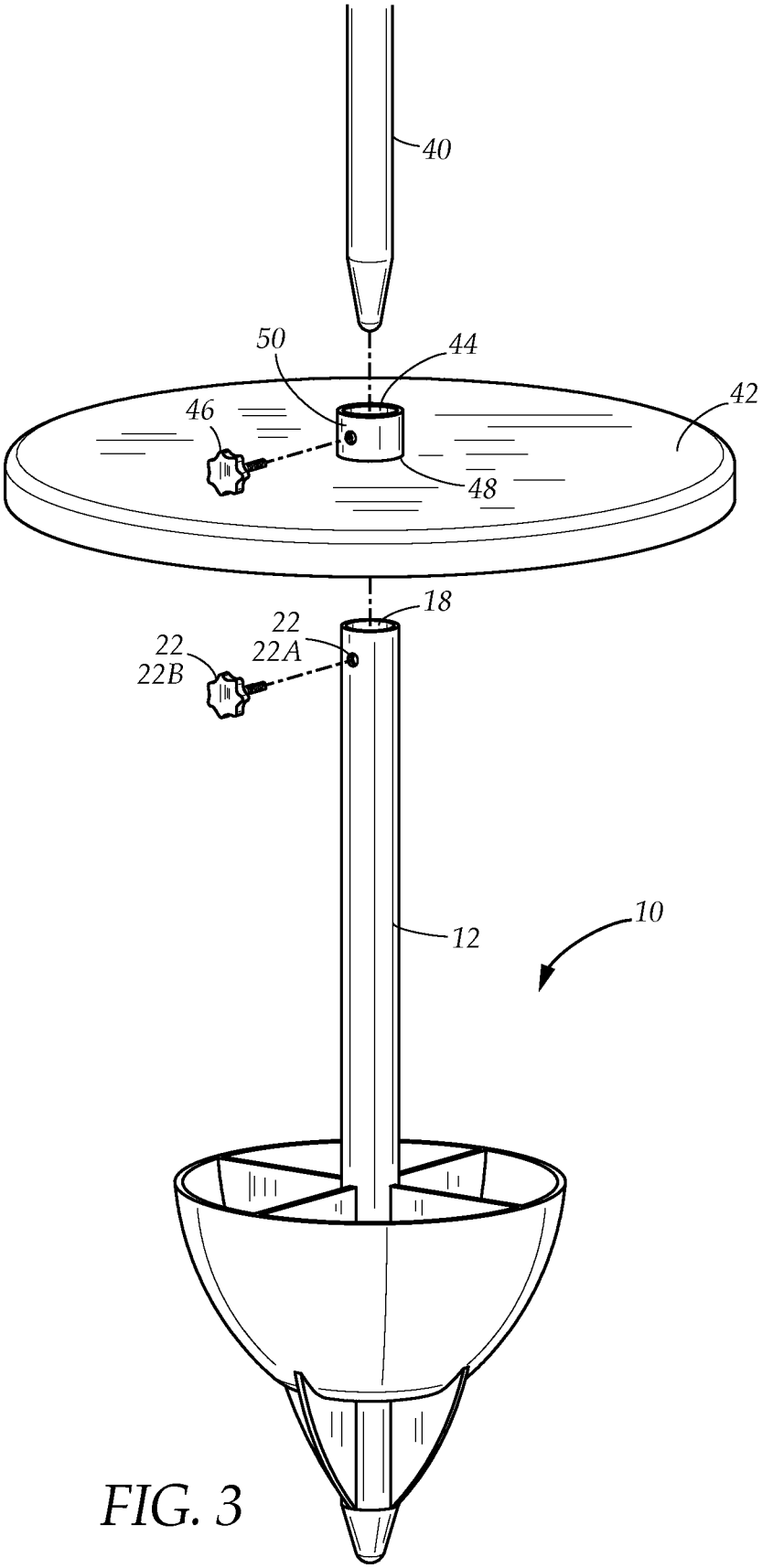
FIG. 3 is an exploded view of the bottom end of a beach umbrella support post, the beach accessory tray, and the beach umbrella anchoring and stabilizing device, illustrating one manner in which a beach umbrella support post and beach accessory tray may be mounted onto the beach umbrella anchoring and stabilizing device according to one embodiment of the present disclosure.
Figure 4:
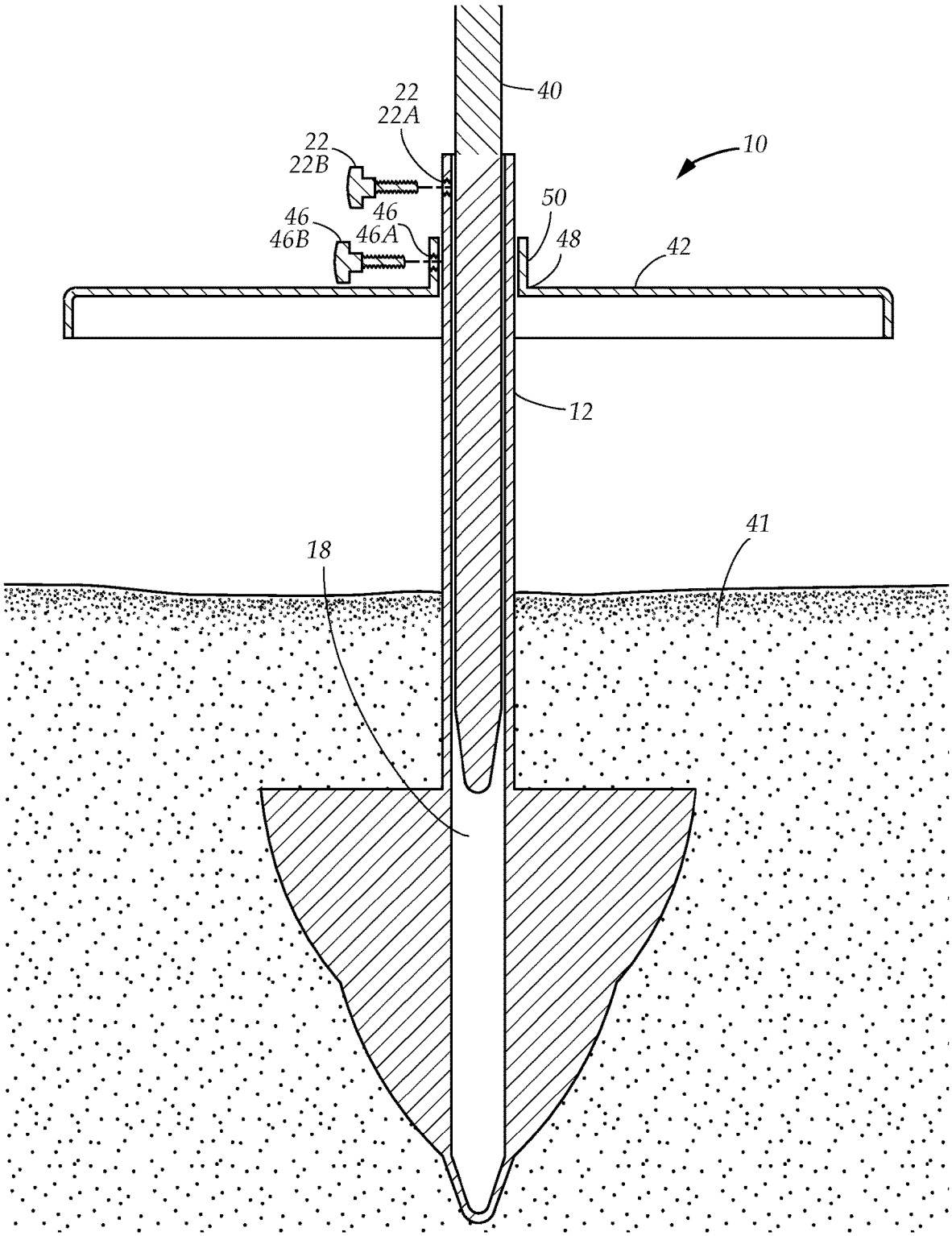
FIG. 4 is a cross-sectional view of the beach umbrella anchoring and stabilizing device buried in the sand with a beach accessory tray mounted onto the support shaft and a beach umbrella support post mounted into the support shaft, illustrating one manner in which the anchoring container and stabilizing vanes of the beach umbrella anchoring and stabilizing device may be positioned after being buried under the sand and one manner in which the beach accessory tray and the beach umbrella support post may be positioned on the support shaft according to one embodiment of the present disclosure.

Referring now to FIG. 2, FIG. 3, and FIG. 4, the fastener 22 of the support shaft 12 may include an aperture 22A and a hand knob 22B. The aperture 22A may be adapted to receive the hand knob 22B therethrough such that the hand knob 22B may extend through the aperture 22A into the hollow interior 18 to engage a beach umbrella support post 40 mounted into the support shaft 12. In certain embodiments, the aperture 22A is threaded so as to threadably engage the hand knob 22B and provide a means for securing the hand knob 22B in position within the hollow interior 18.

In operation, in some embodiments, the beach umbrella 38 is supported by the beach umbrella anchoring and stabilizing device 10 by mounting the beach umbrella support post 40 into the hollow interior 18 of the support shaft 12. Note, the hollow interior 18 includes a universally sized diameter that is larger than a diameter of the beach umbrella support post 40 such that the support shaft 12 may receive the beach umbrella support post of any variety of beach umbrellas therein. Once mounted into the support shaft 12, the beach umbrella support post 40 may slide longitudinally along the length of the hollow interior 18 to enable the height of the beach umbrella 38 to be adjusted relative to the sand 41 as desired by a user. In some embodiments, the beach umbrella support post 40 is secured in position by rotating the hand knob 22B through the aperture 22A and into the hollow interior 18 to engage the beach umbrella support post 40. The hand knob 22B may be tightened against the beach umbrella support post 40 to fasten the beach umbrella support post 40 in position within the support shaft 12.

In embodiments, the beach umbrella anchoring and stabilizing device 10 further includes a beach accessory tray 42 that is removably attachable to the support shaft 12. The beach accessory tray 42 may include a planar member having a central opening 44 for mounting the beach accessory tray 42 onto the support shaft 12 and/or a second fastener 46 for fastening the beach accessory tray 42 to the support shaft 12. In some embodiments, the central opening 44 includes a perimeter edge 48 having a collar 50 including the second fastener 46. In embodiments, the second fastener 46 comprises an aperture 46A extending through the collar 50 and a hand knob 46B. The aperture 46A may be adapted to receive the hand knob 46B therethrough such that the hand knob 46B may extend through the aperture 46A into the collar 50 to engage the support shaft 12 when the beach accessory tray 42 is mounted thereon. In some embodiments, the aperture 46A is threaded such that it threadably engages the hand knob 46B and provides a means for securing the hand knob 46B in position within the hollow interior 18. The beach accessory tray 42 may slide longitudinally along the length of the support shaft 12 to adjust the height of the beach accessory tray 42 relative to the sand 41.

Figure 6:
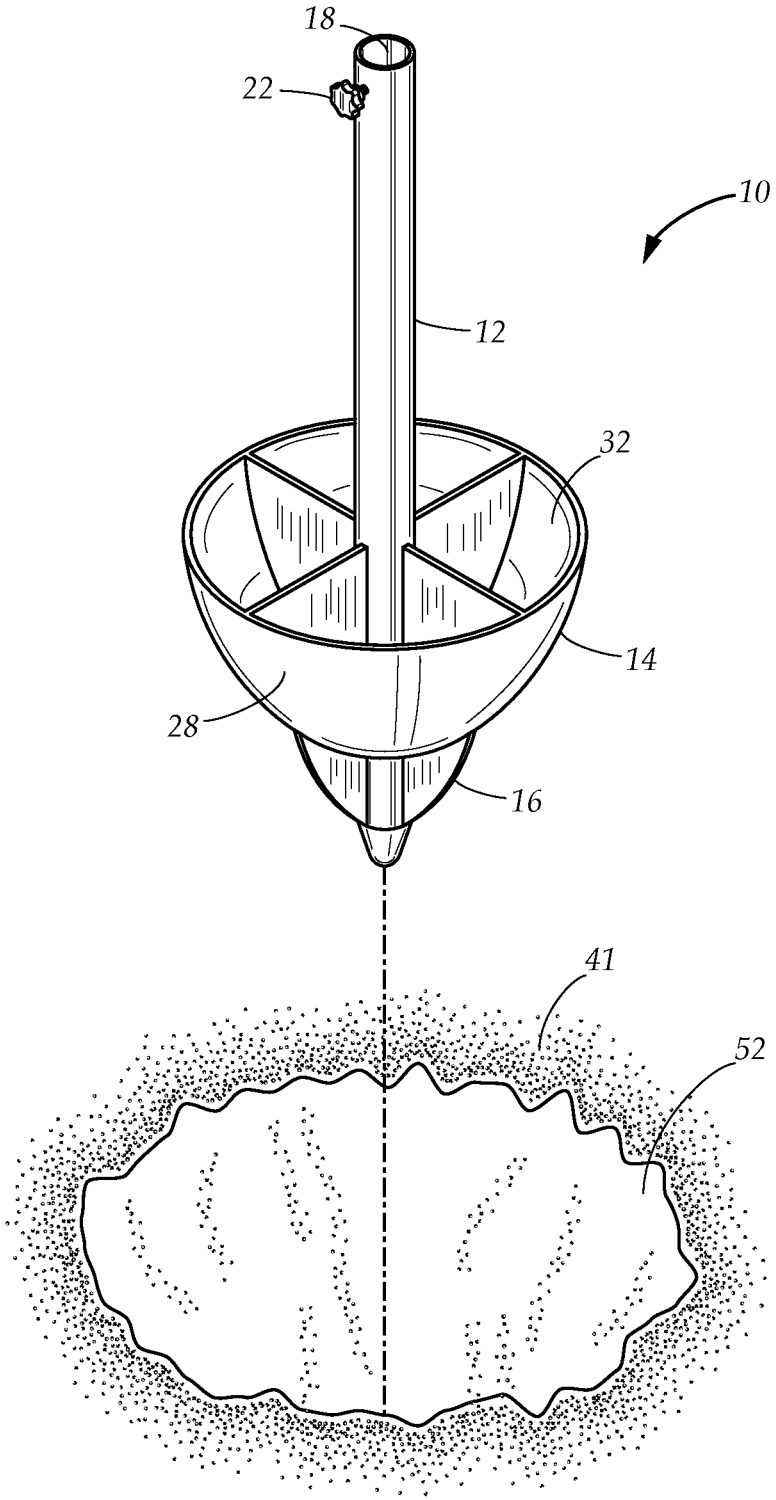
FIG. 6 is a perspective view of the beach umbrella anchoring and stabilizing device going into a hole dug in the sand, illustrating one manner in which the beach umbrella anchoring and stabilizing device may be inserted into the sand prior to being buried according to one embodiment of the present disclosure.
Figure 7:
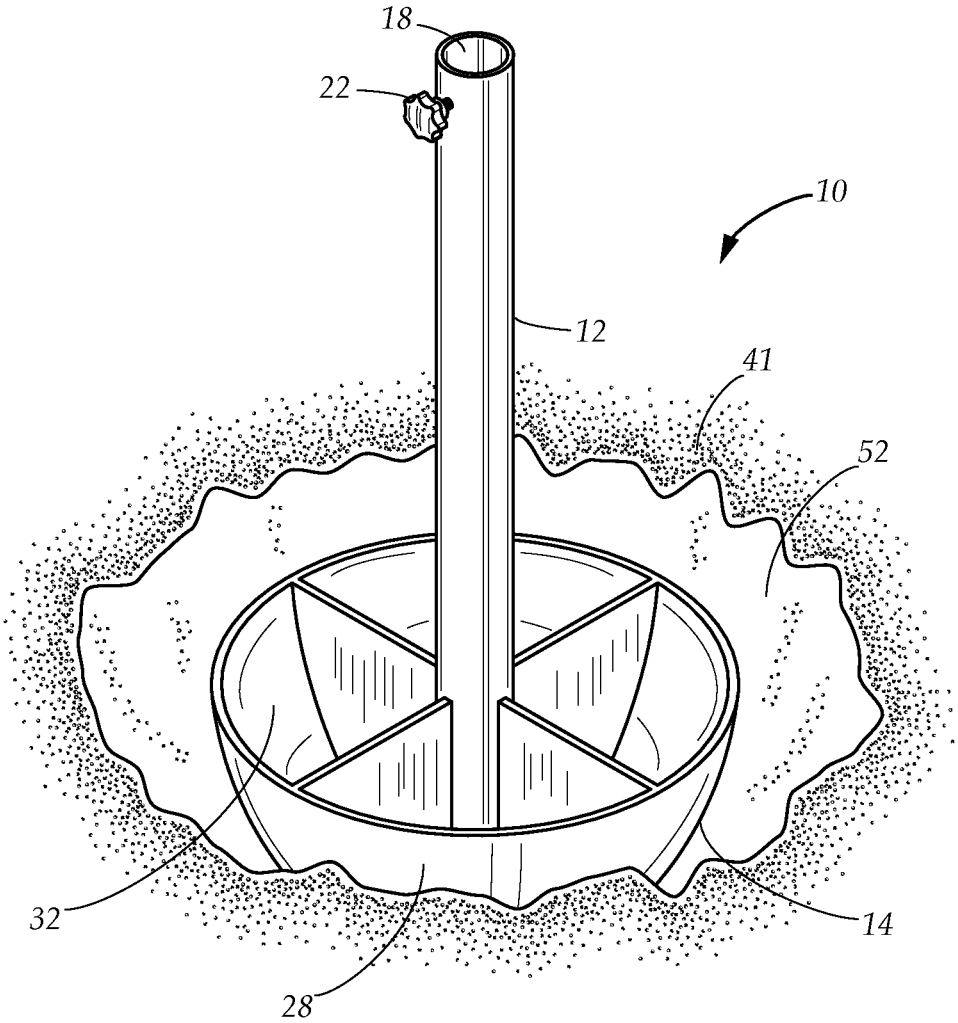
FIG. 7 is a perspective view of the anchoring container of the beach umbrella anchoring and stabilizing device positioned in a hole dug in the sand, illustrating the anchoring container positioned upwardly with respect to the sand surface before the anchoring container is buried in the sand according to one embodiment of the present disclosure.
Figure 8:
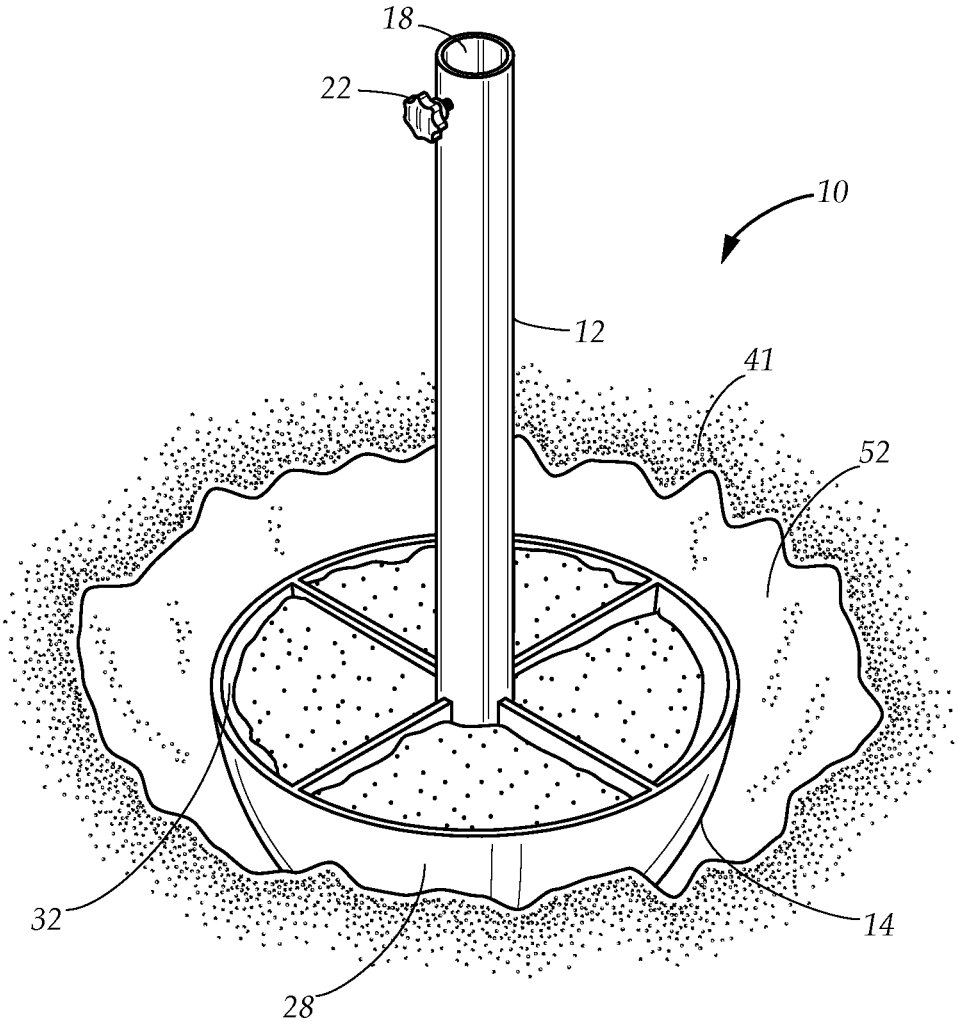
FIG. 8 is a perspective view of the anchoring container of the beach umbrella anchoring and stabilizing device positioned in a hole dug in the sand, illustrating the anchoring container filled with sand prior to being buried in the sand according to one embodiment of the present disclosure.
Figure 9:
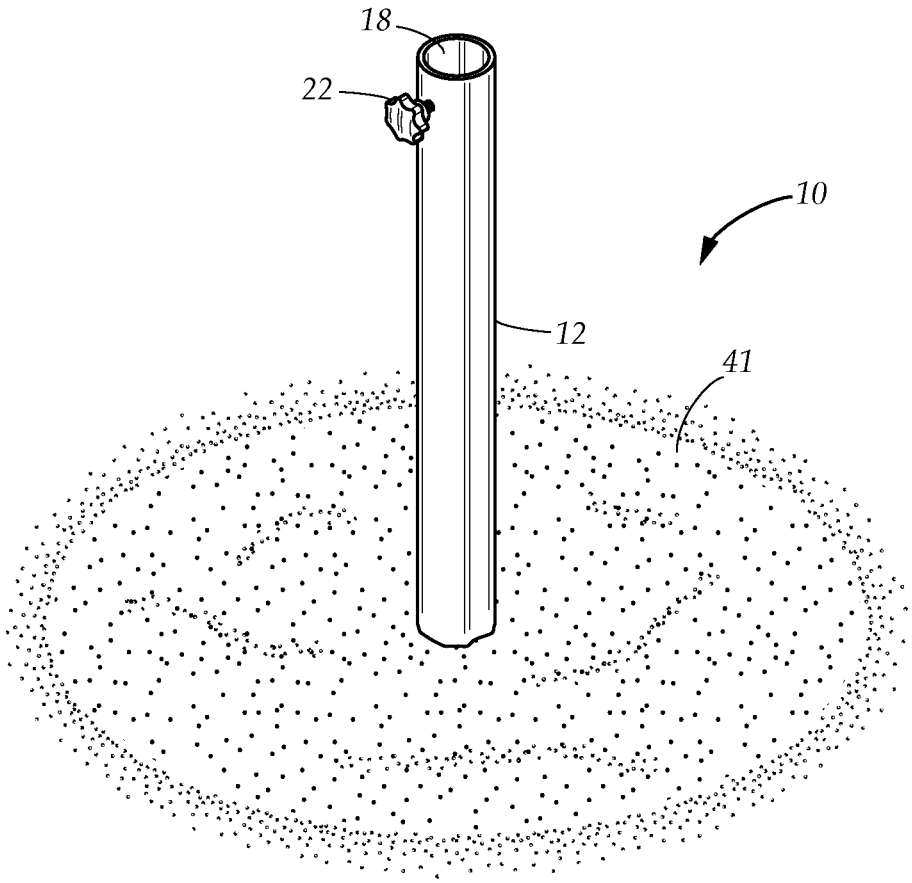
FIG. 9 is a perspective view of the anchoring container of the beach umbrella anchoring and stabilizing device buried in the sand according to one embodiment of the present disclosure.
Figure 10:
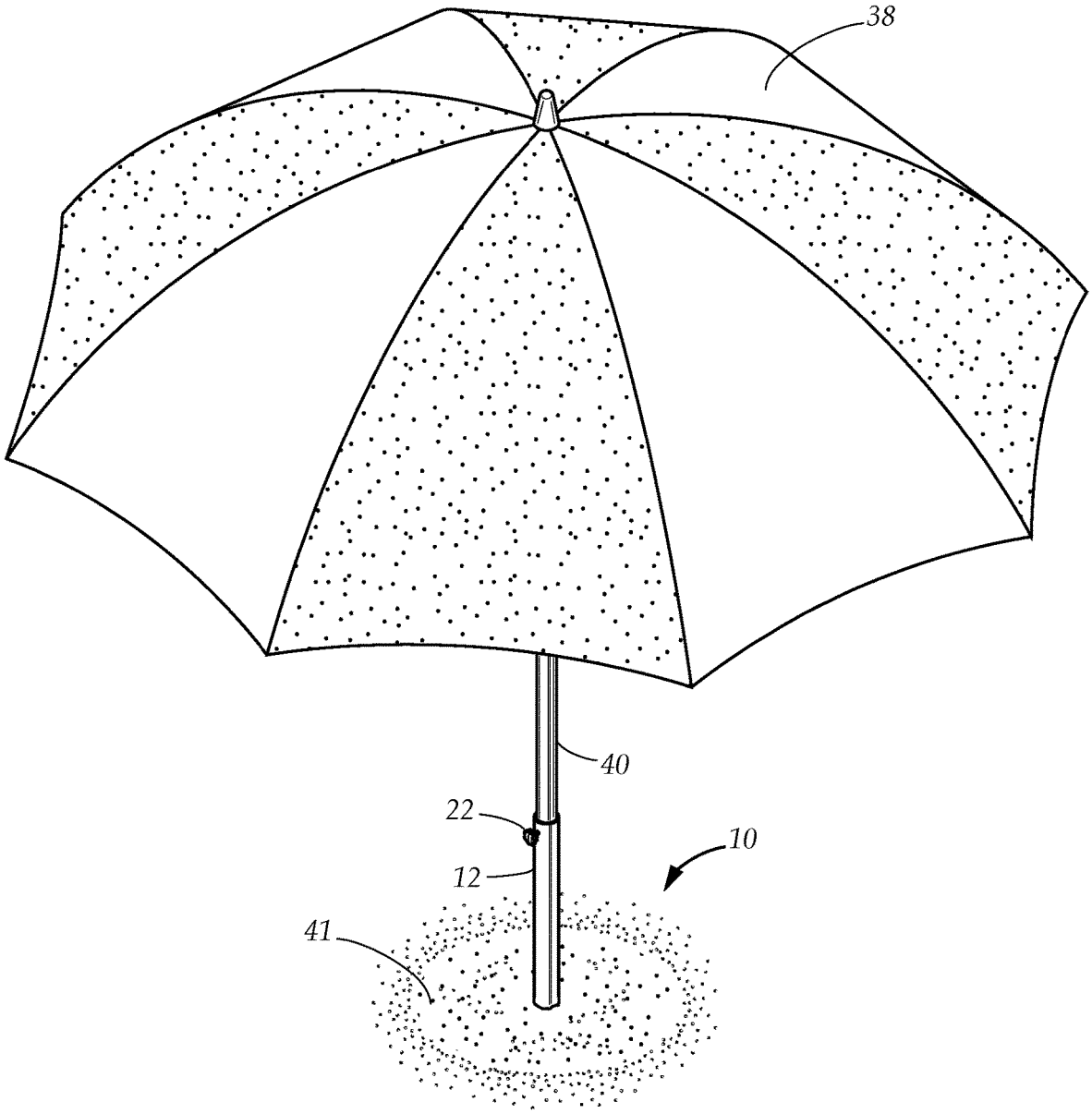
FIG. 10 is a perspective view of the anchoring container of the beach umbrella anchoring and stabilizing device buried in the sand, illustrating the beach umbrella anchoring and stabilizing device anchoring and stabilizing a beach umbrella mounted into the support shaft thereof according to one embodiment of the present disclosure.

Referring now to FIG. 6, FIG. 7, FIG. 8. FIG. 9, and FIG. 10, in one operation of the beach umbrella anchoring and stabilizing device 10, a user first digs a hole 52 in the sand 41 large enough to accommodate the anchoring container 14 and the stabilizing vanes 16. The user may place the anchoring container 14 into the hole 52, orienting the support shaft 12 in a vertical upright orientation. While maintaining the support shaft 12 in the vertical upright orientation, the user may fill and pack the reservoir 32 with sand and, in some embodiments, may also fill and pack the area between the sidewall 28 and the hole 52 with sand until the anchoring container 14 and stabilizing vanes 16 are completely buried underneath the sand 41. The user may mount the beach umbrella 38 into the hollow interior 18 of the support shaft 12 and may secure the beach umbrella 38 at a desired height with respect to the sand 41 by fastening the beach umbrella support post 40 within the support shaft 12 using, for example, the fastener 22.

Figure 11:
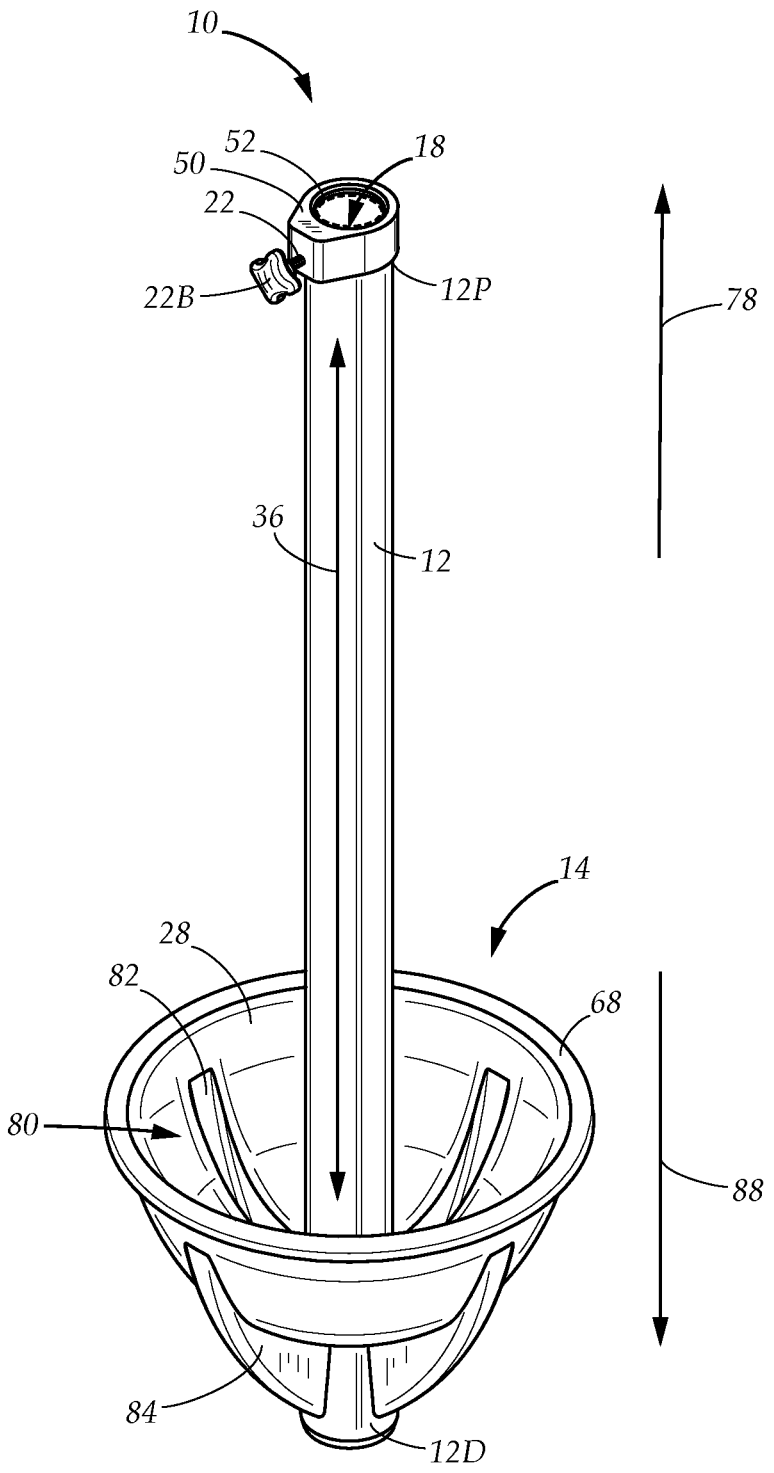
FIG. 11 is a perspective view of another embodiment of a beach umbrella anchoring and stabilizing device in accordance with one embodiment of the present disclosure.
Figure 12:
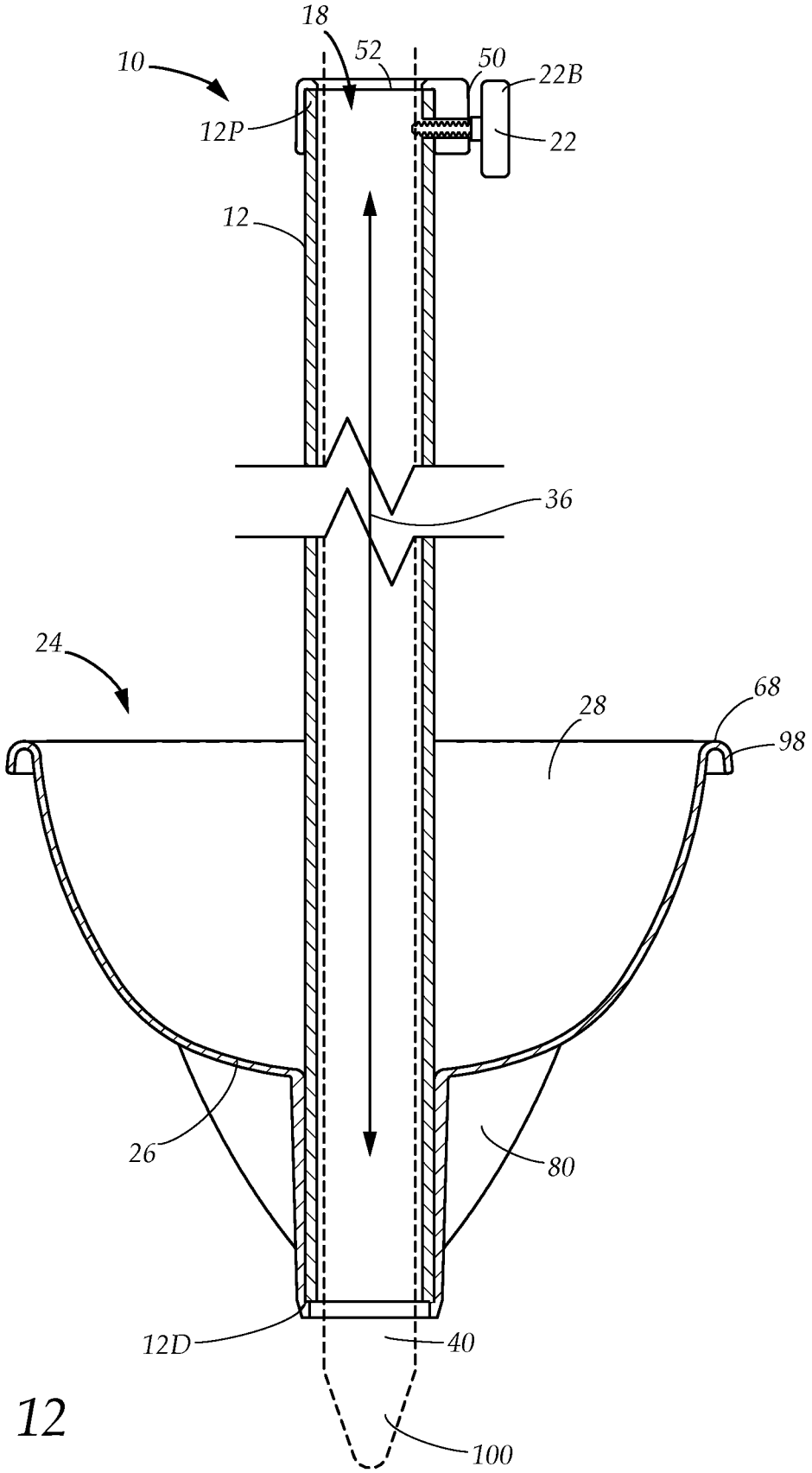
FIG. 12 is a cross-sectional view of the beach umbrella anchoring and stabilizing device of FIG. 11 in accordance with one embodiment of the present disclosure.
Figure 12A:
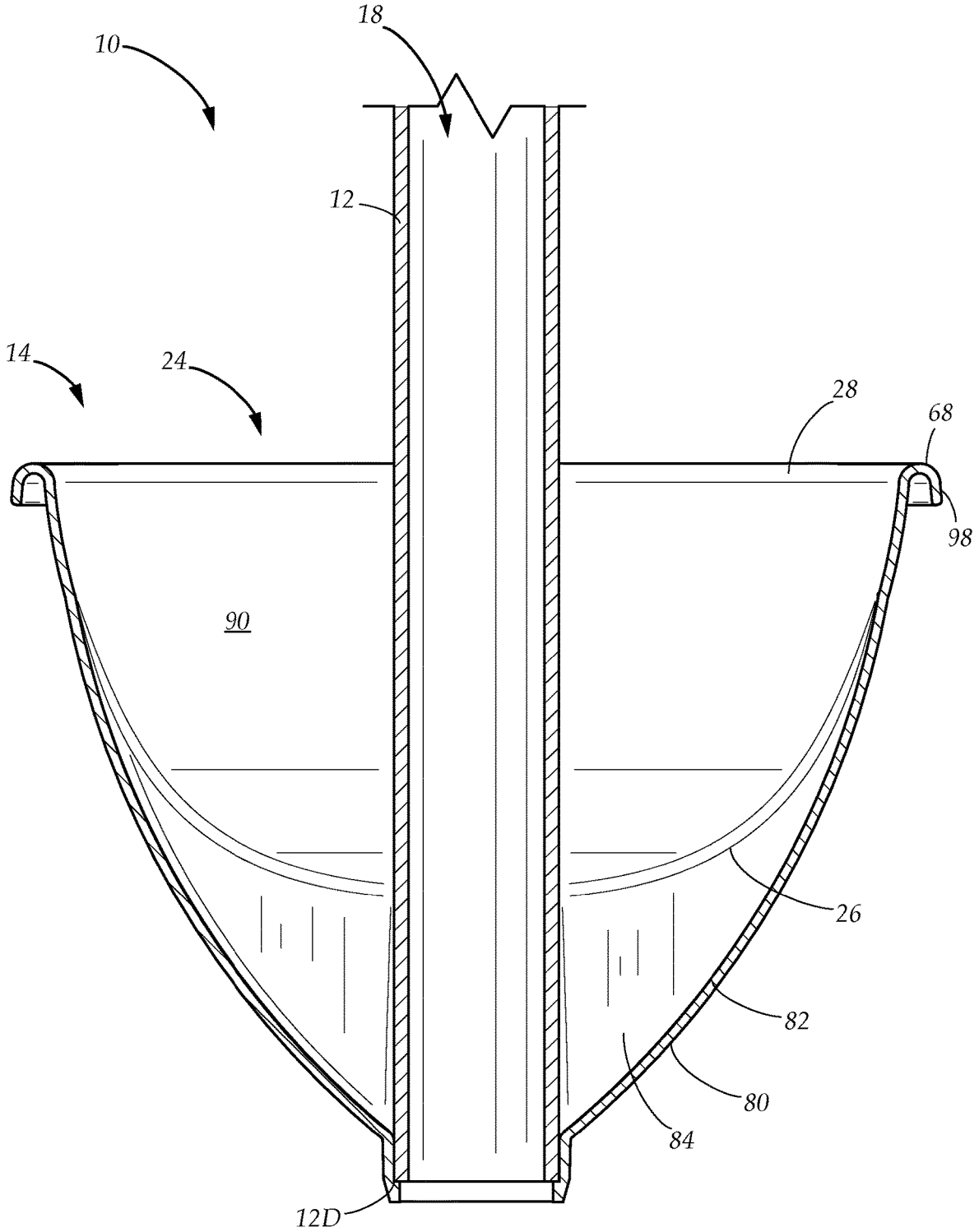
FIG. 12A is a cross-sectional view of representative hollow stabilizing vanes of the embodiment of the beach umbrella anchoring and stabilizing device of FIG. 12.

Referring now to FIGS. 11, 12, and 12A, in some embodiments, a beach umbrella anchoring and stabilizing device 10 is presented that includes an elongated support shaft 12, an anchoring container 14, and one or more hollow stabilizing vanes 80. The beach umbrella anchoring and stabilizing device 10 may be configured to receive and support a personal or commercial beach umbrella having a diameter or span of eight (8) feet, nine (9) feet, or ten (10) feet, for example.

The beach umbrella anchoring and stabilizing device 10 may have a substantially rigid structure including one or more metals or metal alloys, plastics, and/or other suitable rigid materials. In certain embodiments, for example, the beach umbrella anchoring and stabilizing device 10 includes acrylonitrile butadiene styrene ("ABS"), polycarbonate ("PC"), polyphenylene oxide ("PPO"), polyphenylene ether ("PPE"), polyamide ("PA"), polybutylene terephthalate ("PBT"), acrylic, or the like.

In some embodiments, the anchoring container 14 is coupled to a distal end 18 of the elongated support shaft 12. In some embodiments, the elongated support shaft 12, anchoring container 14, and/or hollow stabilizing vanes 80 may be molded or otherwise monolithically formed as a single unit. In other embodiments, the elongated support shaft 12 and the anchoring container 14 may be coupled together via one or more mechanical fasteners and/or connecting mechanisms such as bolts, rivets, grommets, threads, a press fit, and/or any other suitable fastener or fastening mechanism.

In some embodiments, the elongated support shaft 12 extends along a longitudinal axis 36 between a proximal end 12P and the distal end 12D. The elongated support shaft 12 may have a hollow interior 18 configured to receive at least a portion of a beach umbrella support post 40. The elongated support shaft 12 and/or hollow interior 18 may be circular, elliptical, rectangular, triangular, square, polygonal, or may include any other suitable shape. In some embodiments, the hollow interior 18 includes a diameter or width greater than a diameter or width of the beach umbrella support post 40. In one embodiment, the hollow interior 18 includes a diameter of about two (2) inches. In another embodiment, the hollow interior 18 includes a diameter between about two (2) and about two and a half (2.5) inches.

The anchoring container may include an open top 24, a closed bottom 26, and at least one sidewall 28. One or more sidewalls 28 may extend around the elongated support shaft 12 between the open top 24 and the closed bottom 26. In some embodiments, the sidewall 28 may include an arcuate and/or tapered shape. In some embodiments, the sidewall 28 may define a reservoir 90 configured to receive a volume of sand. In some embodiments, the one or more sidewalls 28 may be oriented such that the open top 24 and/or upper perimeter edge 68 includes a diameter or width greater than a diameter or width of the closed bottom 26.

In some embodiments, the open top 24 includes an upper perimeter edge 68 substantially surrounding at least a portion of the elongated support shaft 12. For example, in some embodiments, the upper perimeter edge 68 is substantially circular and spaced apart from the elongated support shaft 12. In some embodiments, the upper perimeter edge 68 substantially surrounds the elongated support shaft 12 at a position distal to a midpoint between the proximal end 12P and the distal end 12D. In certain embodiments, the upper perimeter edge 68 substantially surrounds the elongated support shaft 12 at a position at or distal to approximately one-third of a height of the elongated support shaft 12 measured from the distal end 12D. In these and other embodiments, the closed bottom 26 may be disposed distal to the upper perimeter edge 68 and/or may contact the distal end 12D of the elongated support shaft 12.

In some embodiments, one or more hollow stabilizing vanes 80 extend radially from the elongated support shaft 12 between the closed bottom 26 of the anchoring container 14 and the distal end 12D of the elongated support shaft 12. In certain embodiments, the hollow stabilizing vanes 80 extend in a distal direction 88 between at least a portion of the sidewall 28 of the anchoring container 14 and the distal end 12D of the elongated support shaft 12.

In these and other embodiments, each of the hollow stabilizing vanes 80 defines an interior trough 82 configured to receive a portion of the volume of sand and an exterior surface 84 configured to engage a surrounding volume of sand. In some embodiments, the hollow stabilizing vane 80 and interior trough 82 include an elongate arcuate shape having a depth that tapers from the distal end 12D of the elongated support shaft 12 toward the sidewall 28 and/or closed bottom 26 of the anchoring container 14. In this manner, the interior trough 82 may maximize a volume of sand retained by the anchoring container 14, thereby optimizing beach umbrella stability.

Additionally, the tapered shape of the hollow stabilizing vanes 80 may contribute to an overall tapered shape of an exterior of the anchoring container 14, thereby facilitating excavation of surrounding sand and burying the anchoring container 14 therein. In some embodiments, the surrounding sand accumulates within the spaces between each hollow stabilizing vane 80, thereby further stabilizing the anchoring container 14 and preventing its lateral movement and/or disengagement relative to the sand or beach.

In some embodiments, a collar 50 is coupled to the proximal end 12P of the elongated support shaft 12 and configured to selectively secure a position of the beach umbrella support post 40 relative to the elongated support shaft 12. The collar 50 may be constructed of one or more metals or metal alloys, plastics, and/or other suitable rigid materials. In some embodiments, the collar 50 is configured to apply pressure to the beach umbrella support post 40 to secure its position relative to the elongated support shaft 12.

In one embodiment, the collar 50 includes, for example, a cylindrical or substantially cylindrical clamp configured to encircle or substantially encircle a perimeter of the beach umbrella support post 40. In some embodiments, the collar 50 includes a hole 52 having dimensions sufficient to accommodate the beach umbrella support post 40 therethrough. In some embodiments, the collar 50 includes a fastener 22 configured to reduce a size of the hole 52 such that actuating the fastener 22 causes the collar 50 to tighten around the beach umbrella support post 40, thereby constraining its movement and maintaining its alignment with the elongated support shaft 12. In some embodiments, the fastener 22 includes a screw, post, bar, or other suitable mechanical tightening element 114 coupled to a hand knob 22B or other actuator to facilitate tightening and/or loosening the collar 50 relative to the beach umbrella support post 40.

Figure 13:
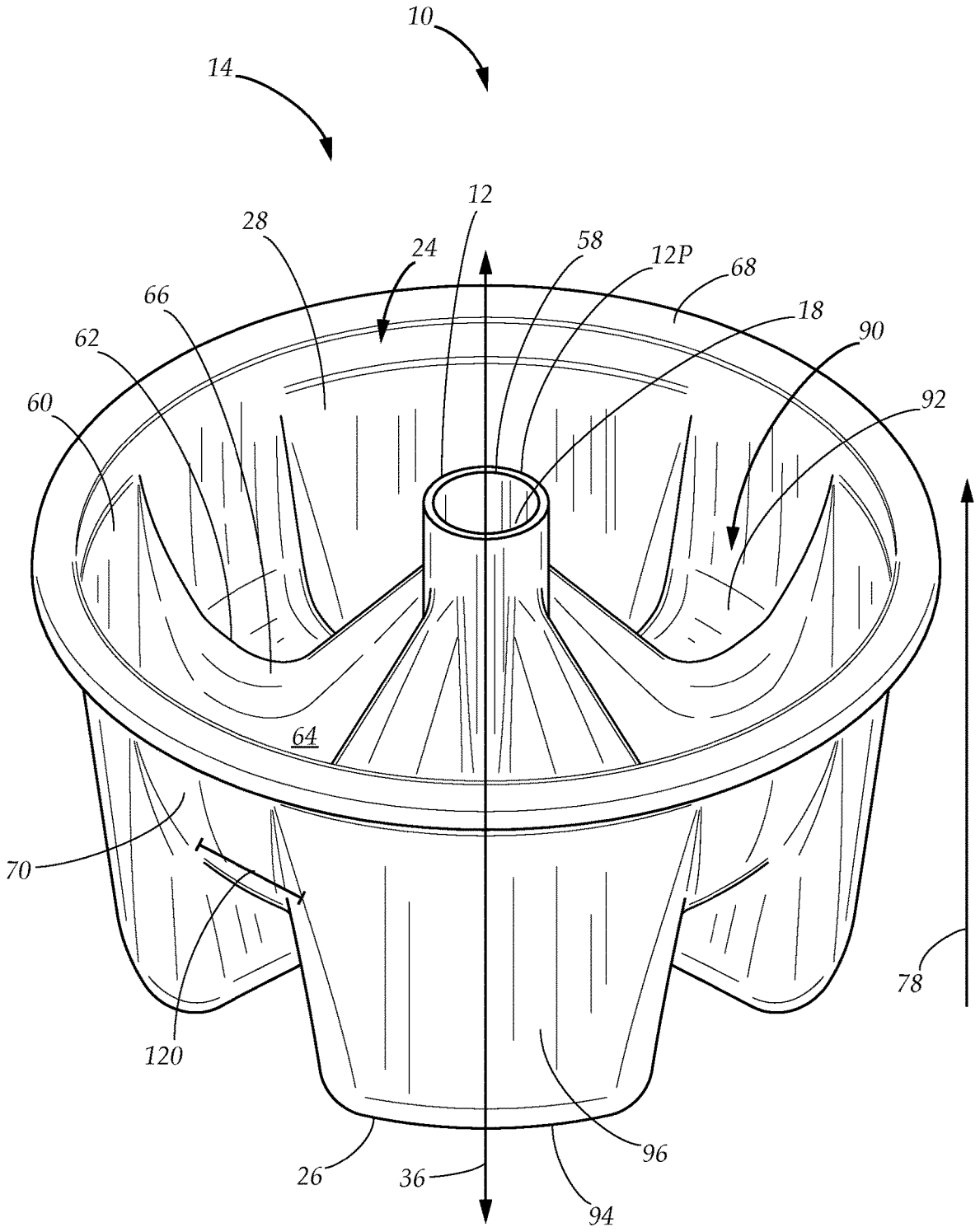
FIG. 13 is a perspective view of one embodiment of an anchoring container in accordance with one embodiment of the present disclosure.
Figure 14:
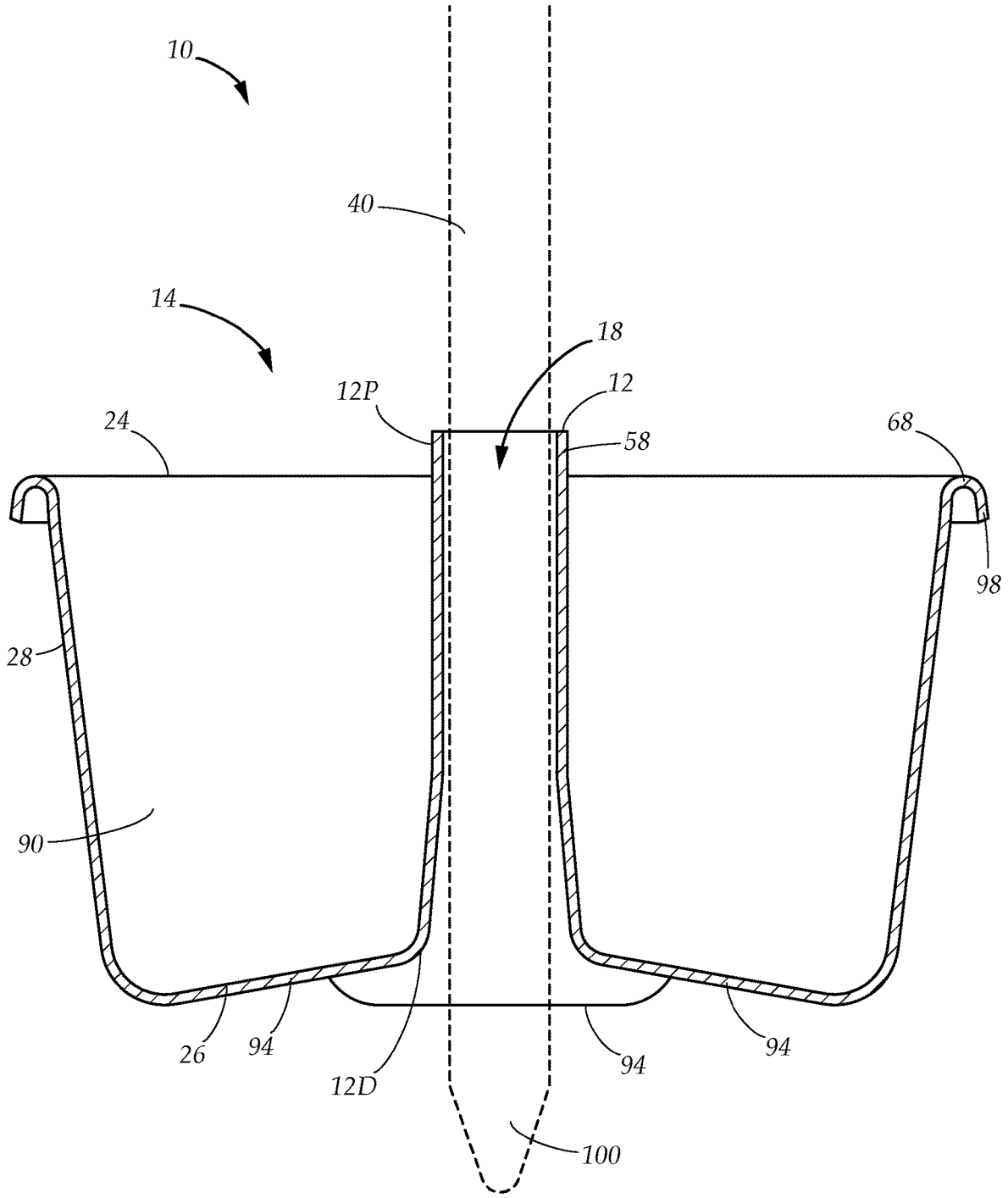
FIG. 14 is a cross-sectional view of the anchoring container of FIG. 13 in accordance with one embodiment of the present disclosure.
Figure 18:
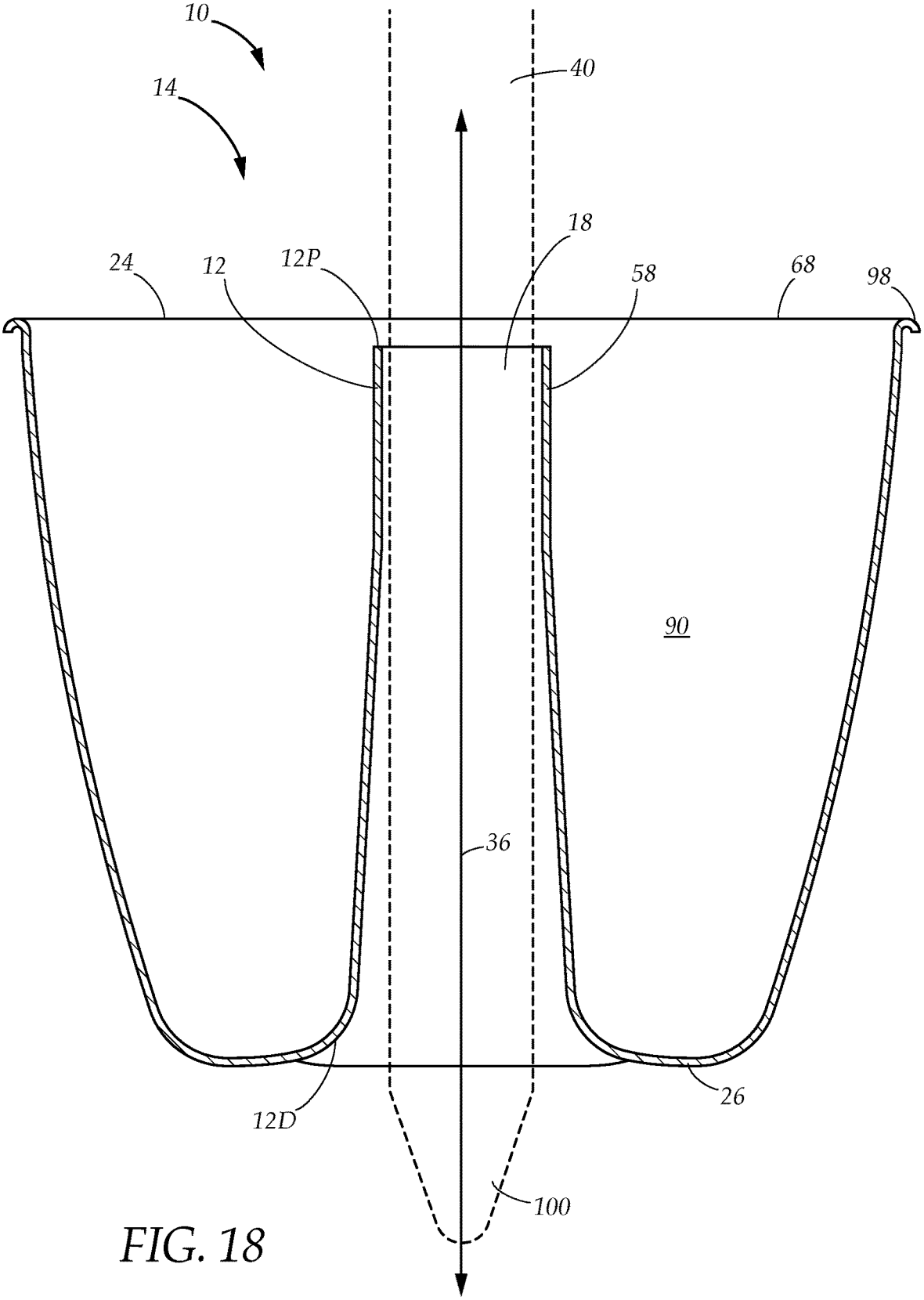
FIG. 18 is a cross-sectional view of the anchoring container of FIG. 17B illustrating a beach umbrella support post extending therethrough in accordance with certain embodiments of the present disclosure.

Referring now to FIGS. 13, 14 and 18, in some embodiments, the beach umbrella anchoring and stabilizing device 10 includes an elongated support shaft 12 and an anchoring container 14 having one or more gussets 60. In some embodiments, the anchoring container 14 includes an open center column 58 formed therein. In certain embodiments, the elongated support shaft 12 extends from and/or includes the center column 58. In other embodiments, the center column 58 is separate from the elongated support shaft 12 but configured to receive and/or couple to the elongated support shaft 12.

Figure 15:
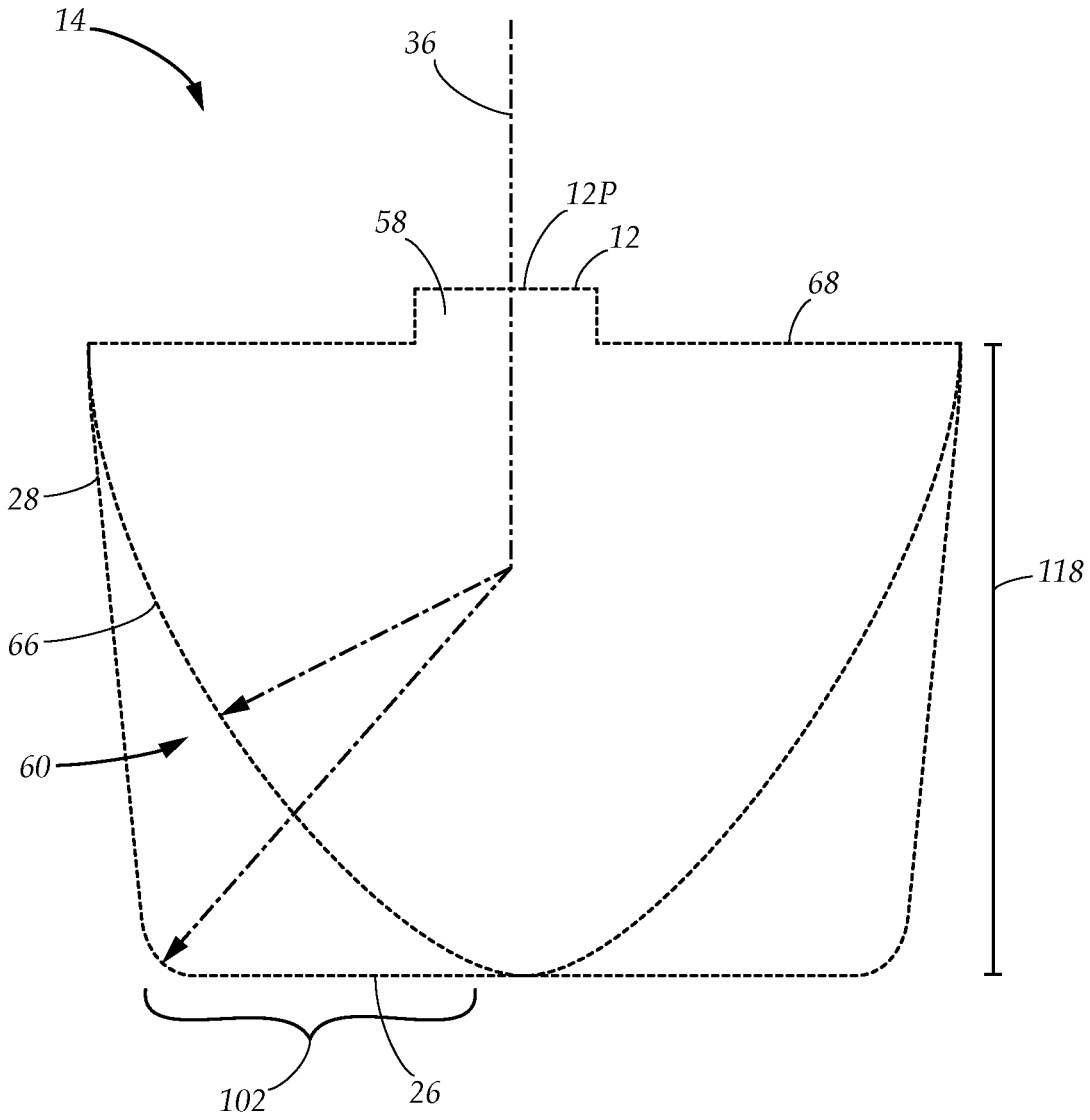
FIG. 15 is a cross-sectional plan view of the anchoring container of FIG. 13 in accordance with one embodiment of the present disclosure.

The elongated support shaft 12 may extend along a longitudinal axis 36 between a proximal end 12P and a distal end 12D. The elongated support shaft 12 may be open at its proximal end 12P and may include a hollow interior 18 configured to receive at least a portion of a beach umbrella support post 40. In some embodiments, as shown in FIGS. 14 and 15, while still referring to FIGS. 13 and 18, the proximal end 12P of the elongated support shaft 12 is disposed at a position proximal to the upper perimeter edge 68 of the anchoring container 14.

In some embodiments, the elongated support shaft 12 includes an open distal end 12D such that the beach umbrella support post 40 extends partially or fully through the distal end 12D. For example, the beach umbrella support post 40 may include a pointed distal end 12D, auger 100, or other tool coupled to its distal end 12D. In some embodiments, the pointed distal end 12D or auger 100 may extend beyond the closed bottom 26 the anchoring container 14 to facilitate a user's ability to excavate surrounding sand and thereby securely anchor the beach umbrella anchoring and stabilizing device 10 relative to the beach or sandy surface.

The anchoring container 14 may include a closed bottom 26 defining a substantially planar surface 94 to facilitate increased contact between the anchoring container 14 and the beach or sandy surface on which it is disposed. In this way, the planar surface 94 further stabilizes the beach umbrella anchoring and stabilizing device 10 with respect to lateral forces and protects against unintended disengagement with the anchoring surface.

At least one sidewall 28 may extend between the upper perimeter edge 68 and the closed bottom 26. In some embodiments, at least a portion of the upper perimeter edge 68 includes a lip 98 extending therefrom. In some embodiments, the closed bottom 26 includes a substantially planar surface 94. In these and other embodiments, the one or more sidewalls 28 may extend in a direction substantially parallel to the longitudinal axis 36 to form an angle of between about ninety degrees (90°) and about forty-five degrees (45°) relative to the closed bottom 26 and/or planar surface 94.

In some embodiments, a reservoir 90 configured to retain a volume of sand may be formed between the sidewall 28, the closed bottom 26 and adjacent gussets 60. In some embodiments, at least a portion of the planar surface 94 forms a base of the reservoir 90. In some embodiments, the reservoir 90 includes at least one corner including the angle between about ninety degrees (90°) and about forty-five degrees (45°) between the sidewall 28 and the closed bottom 26 and/or planar surface 94. In this manner, stability of the beach umbrella anchoring and stabilizing device 10 may be maximized with respect to the anchoring surface.

In some embodiments, one or more gussets 60 extend radially from the elongated support shaft 12, between the elongated support shaft 12 and the sidewall 28. In some embodiments, the gussets 60 are spaced at substantially equal intervals around the elongated support shaft 12. In some embodiments, each of the gussets is substantially contiguous with the elongated support shaft 12, the sidewall 28, and/or the closed bottom 26. In other embodiments, at least a portion of one or more of the gussets 60 may be spaced apart from the elongated support shaft 12, the sidewall 28, and/or the closed bottom 26.

Referring now to FIG. 15, while still referring to FIGS. 13 and 14, one or more of the gussets 60 may extend in a proximal direction 78 from the closed bottom 26 such that a height 118 of the gusset 60 is substantially parallel to the longitudinal axis 36 and a width 102 of the gusset 60 is substantially perpendicular relative to the longitudinal axis 36. In certain embodiments, as shown in FIG. 17B, the height 118 of the gusset 60 is at least twice the width 102 of the gusset 60. In some embodiments, the height 118 of the gusset 60 is at least greater than the width 102 of the gusset 60. In other embodiments, as shown in FIG. 17A, for example, the height 118 of the gusset 60 is equal to or less than the width 102 of the gusset 60.

In some embodiments, each of the gussets 60 includes a first side surface 62, a second side surface 64, and a top surface 66. The first side surface 62 and the second side surface 64 may extend between the closed bottom 26 and the top surface 66. In certain embodiments, the top surface 66 of each gusset 60 is disposed distal to the proximal end 12P of the hollow support shaft 12 and the upper perimeter edge 68 of the anchoring container 14.

In some embodiments, as shown in FIG. 13 while still referring to FIG. 15, the top surface 66 of the gusset 60 is concave between the at least one sidewall 28 and the elongated support shaft 12 such that a midpoint of the top surface 66 is positioned distal to a height 118 of the gusset 60 at either the sidewall 28 or the elongated support shaft 12. In other embodiments, as shown in FIG. 15, the height 118 of the gusset 60 tapers from the sidewall 28 to the elongated support shaft 12 such that the top surface 66 is inclined from the closed bottom 26 to the sidewall 28.

Figure 17A:
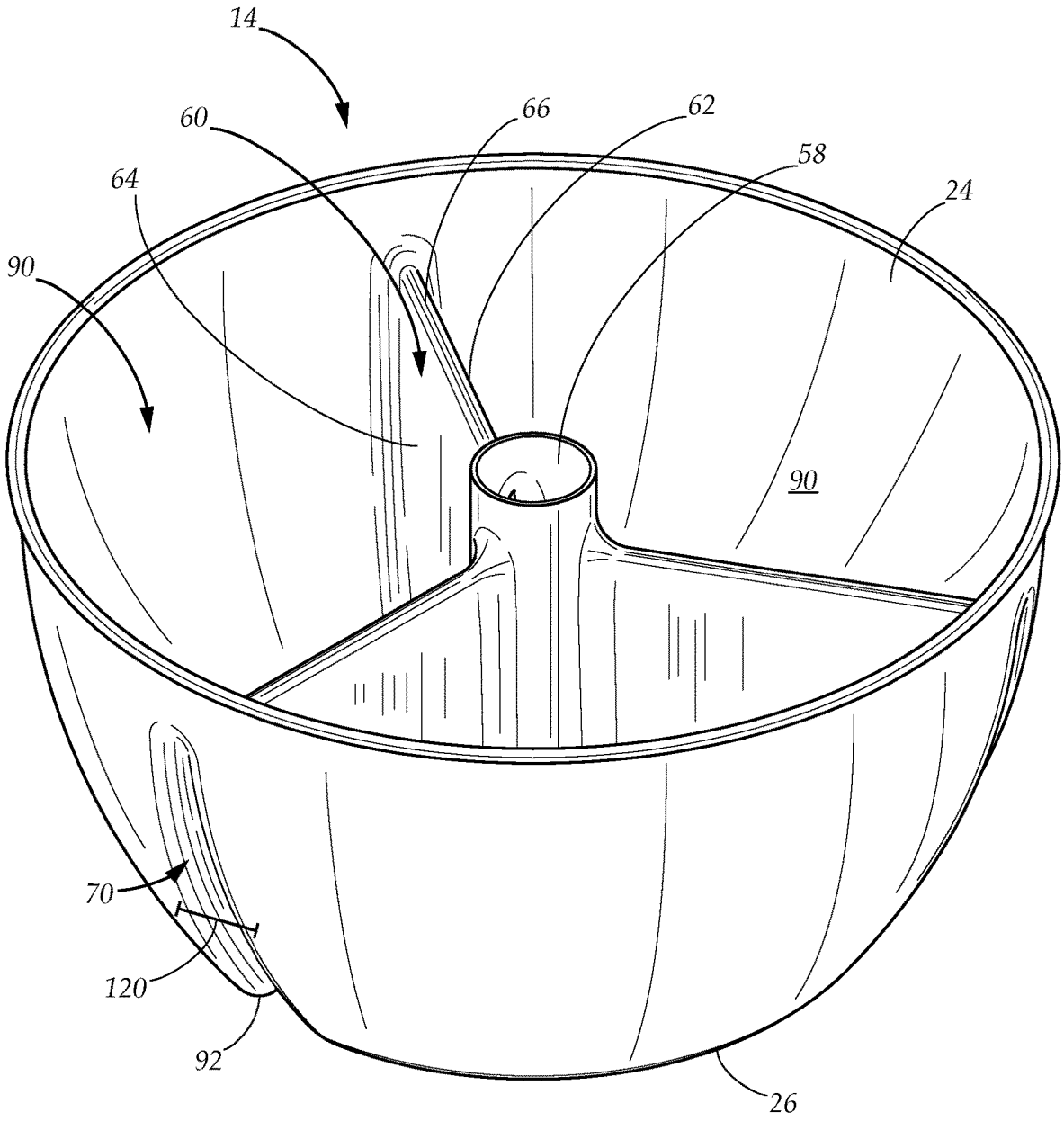
FIG. 17A is a perspective view of another embodiment of an anchoring container in accordance with one embodiment of the present disclosure.
Figure 17B:
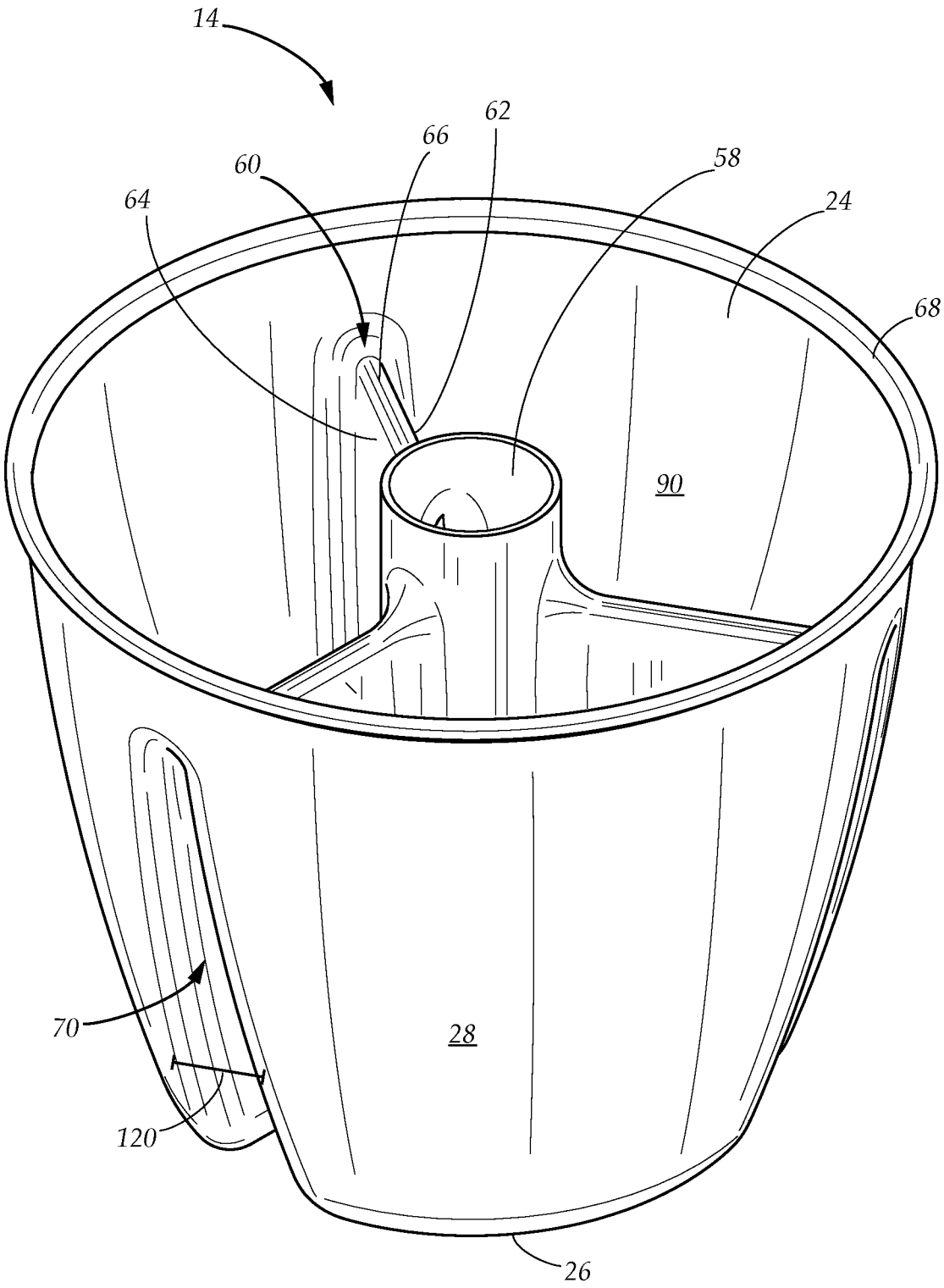
FIG. 17B is a perspective view of still another embodiment of an anchoring container in accordance with one embodiment of the present disclosure.

In certain embodiments, as shown in FIGS. 17A and 17B while still referring to FIG. 15, each of the gussets 60 includes a depth 120 between the first side surface 62 and the second side surface 64. The depth 120 may taper from the closed bottom 26 towards the top surface 66 such that the top surface 66 is more narrow than a distance between the first side surface 62 and the second side surface 64 at the closed bottom 26. In other embodiments, the depth 120 may be substantially consistent along the height 118 of the gusset 60.

Figure 16:
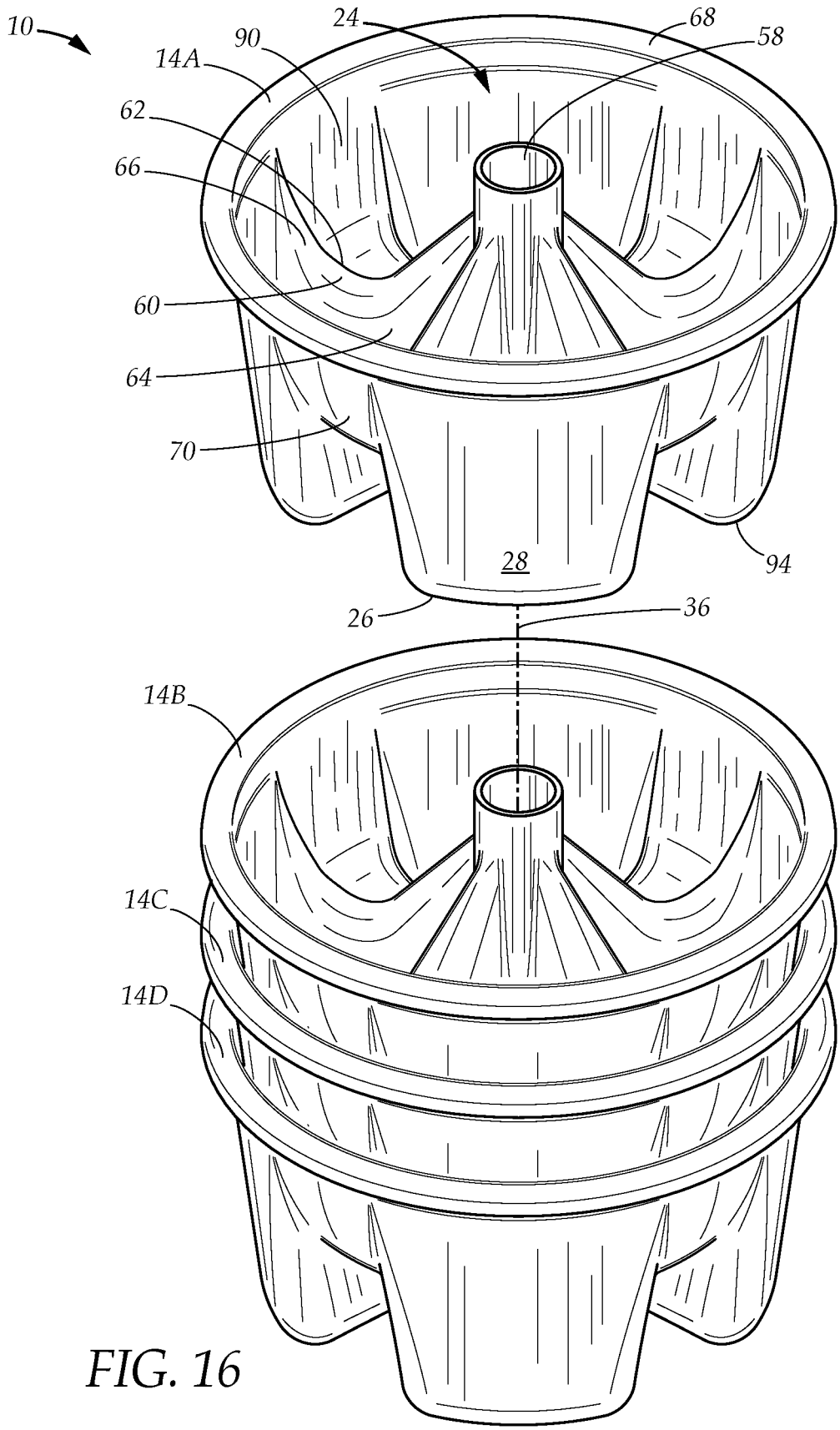
FIG. 16 is a perspective view of multiple of the anchoring containers of FIG. 13 in a stacked configuration in accordance with some embodiments of the present disclosure.
Figure 19:
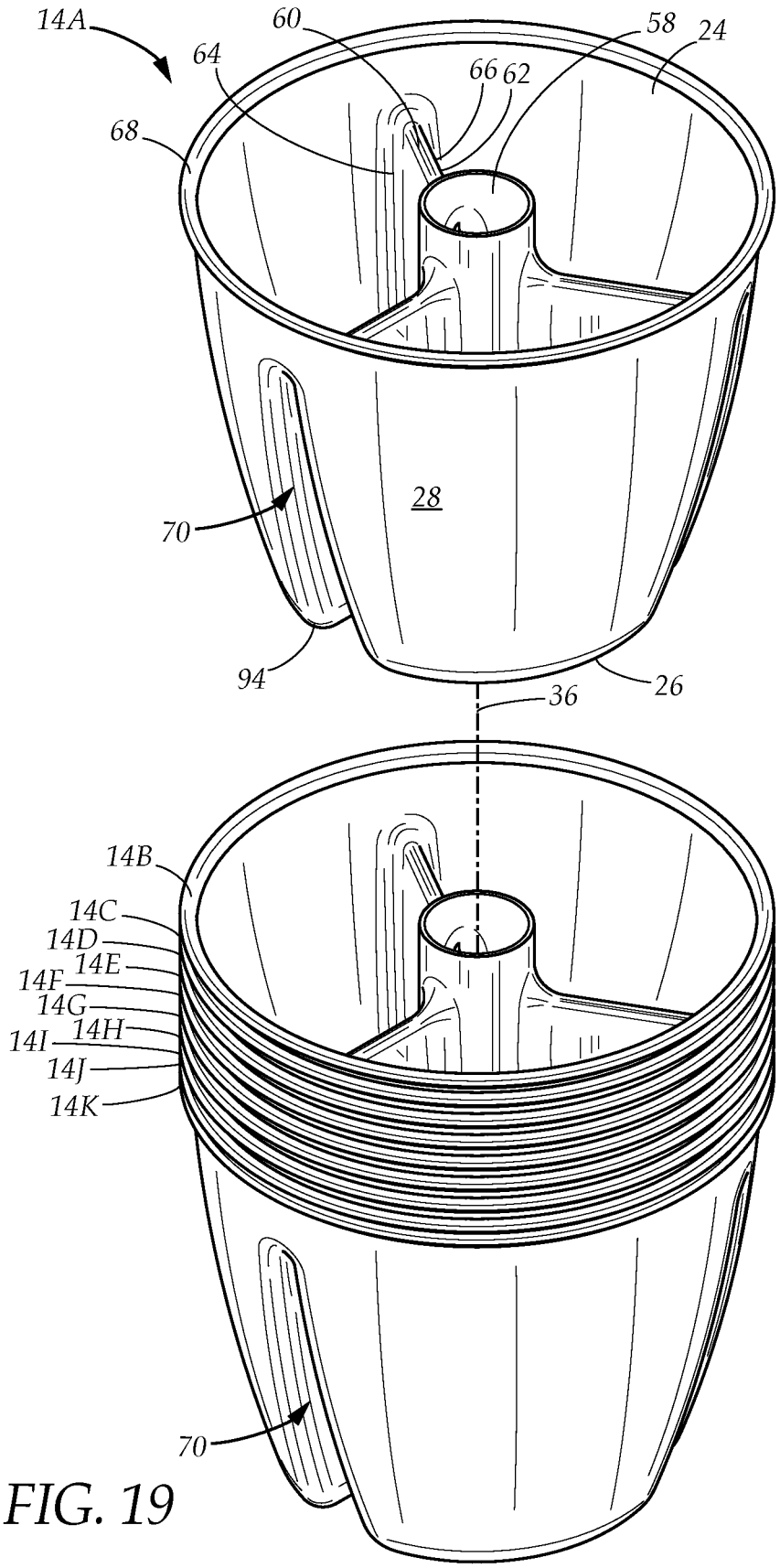
FIG. 19 is a perspective view of multiple of the anchoring containers of FIG. 19 in a stacked configuration in accordance with some embodiments of the present disclosure.

Referring now to FIGS. 16 and 19, in certain embodiments, the substantially planar surface 94 includes multiple vaulted portions 70. Each of the vaulted portions 70 may correspond to each of the gussets 60. In certain embodiments, an exterior surface disposed opposite the top surface 66 of the gusset forms the vaulted portion 70. In these and other embodiments, the vaulted portion 70 is disposed proximal to, or elevated, relative to the closed bottom 26. In some embodiments, each of the vaulted portions 70 is configured to accommodate surrounding sand, thereby further securing the anchoring container 14A—14K relative to the sand and/or beach.

In certain embodiments, the vaulted portions 70 of a first anchoring container 14*a* are configured to receive the gussets 60 of a second anchoring container 14*b* when the first anchoring container 14*a* and the second anchoring container 14*b* are in a stacked configuration. Similarly, in some embodiments, the center column 58 of the first anchoring container 14*a* is configured to align with the center column 58 of the second anchoring container 14*b* in a stacked configuration. Further, in certain embodiments, the sidewalls 28 of the first anchoring container 14*a* are configured to fit within the sidewalls 28 of the second anchoring container 14*b* with only the upper perimeter edges 68 of each of the first and the second anchoring containers 14*a*, 14*b* being exposed.

In this manner, two or more anchoring containers 14A—14K may fit tightly together in a stacked arrangement such that multiple anchoring containers 14A—14K occupy minimal space. As a result, the disclosed embodiments may minimize an amount of packing material needed for marketing and/or transporting more than one beach umbrella anchoring and stabilizing device 10 while also minimizing associated costs.

Figure 20:
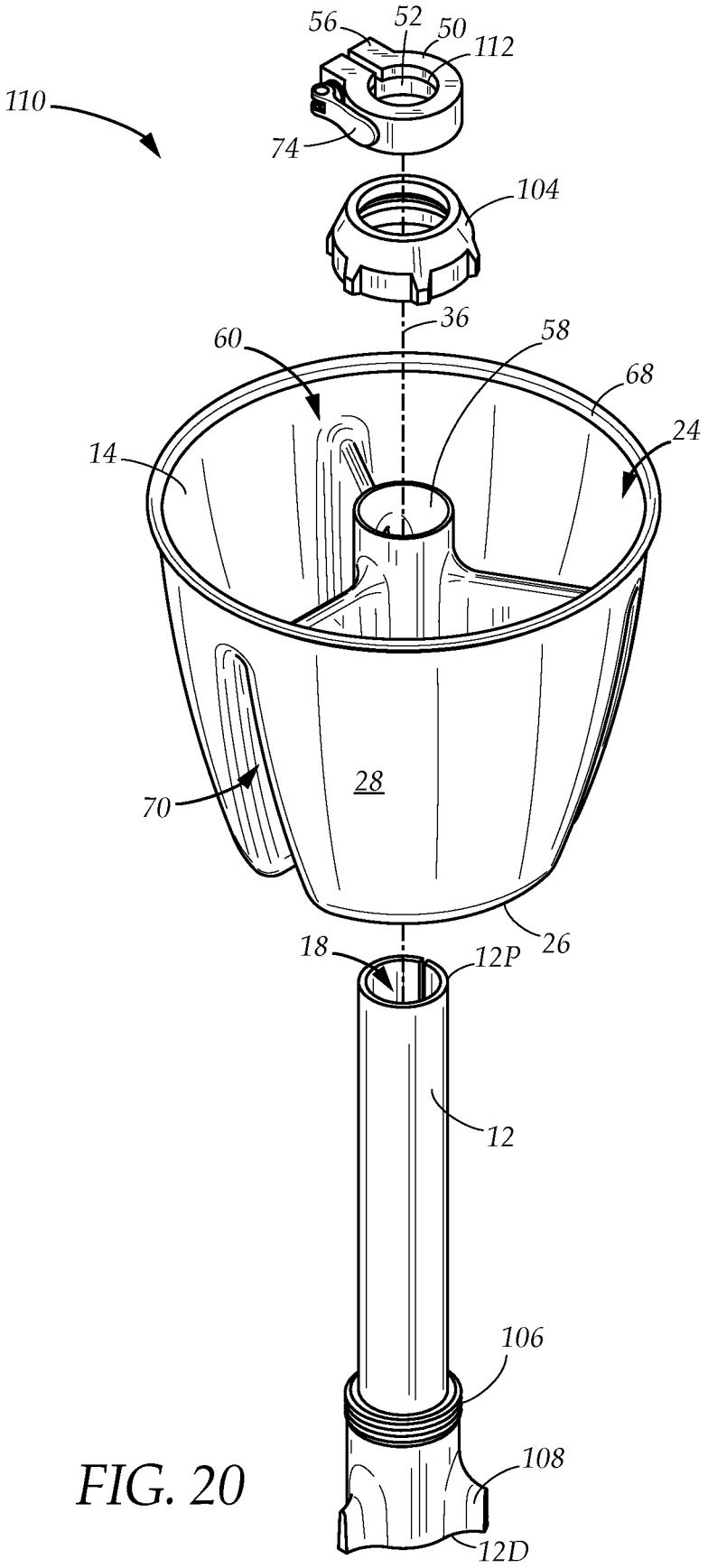
FIG. 20 is an exploded perspective view of a representative embodiment of a beach umbrella anchoring and stabilizing system in accordance with one embodiment of the present disclosure.
Figure 21:
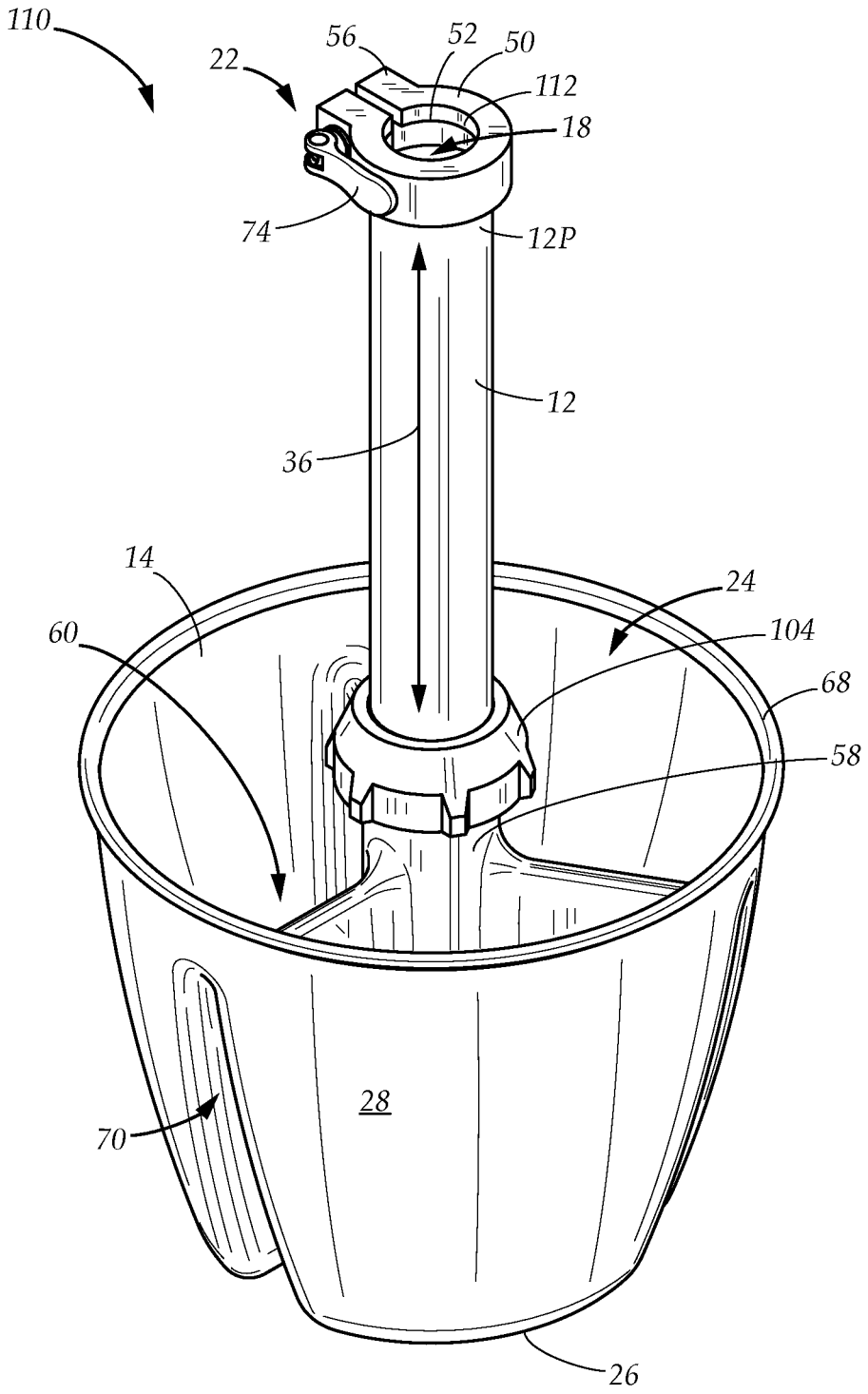
FIG. 21 is a perspective view of the beach umbrella anchoring and stabilizing system of FIG. 20 assembled in accordance with some embodiments of the present disclosure.

Referring now to FIGS. 20 and 21, a beach umbrella anchoring and stabilizing system 110 may include multiple components that may be assembled to anchor and/or support a beach umbrella. In some embodiments, the beach umbrella anchoring and stabilizing system 110 includes an elongated support shaft 12, an anchoring container 14, a securing element 104, and a collar 50. The elongated support shaft 12 may extend along a longitudinal axis 36 between a proximal end 12P and a distal end 12D. When assembled, the anchoring container 14 may be coupled to the elongated support shaft 12 such that the elongated support shaft 12 is maintained in a substantially centered, upright position along the longitudinal axis 36. In some embodiments, at least a portion of the elongated support shaft 12 is hollow. The elongated support shaft 12 may include an inner diameter sufficient to accommodate an outer diameter of a beach umbrella support post 40 as shown in dotted lines in FIG. 18. The proximal end 12P may be open such that the elongated support shaft 12 may receive the beach umbrella support post 40 therein.

In some embodiments, the anchoring container 14 includes a hollow center column 58. Upon assembly, the center column 58 may align with the longitudinal axis 36. In some embodiments, the center column 58 is substantially cylindrical. In some embodiments, the center column 58 is configured to receive at least a portion of the elongated support shaft 12 therethrough. In these and other embodiments, the center column 58 is configured to couple to at least a portion of the elongated support shaft 12.

In one embodiment, the elongated support shaft 12 is configured to extend through the center column 58 such that the distal end 12D and/or ancillary stabilizing feature 108 is maintained at a position distal to the center column 58. In some embodiments, the elongated support shaft 12 includes a connection feature 106 disposed proximal to the distal end 12D. The connection feature 106 may include, for example, a threaded connection configured to couple to a corresponding securing element 104 to couple the center column 58 to the distal end 12D of the elongated support shaft 12. Upon assembly, in some embodiments, the connection feature 106 may be accessible at a position proximal to the center column 58 of the anchoring container 14.

In certain embodiments, the securing element 104 may be configured to engage the connection feature 106 and/or the center column 58 of the anchoring container 14. The securing element 104 may include, for example, a ring having an inner diameter greater than an outer diameter of the elongated support shaft 12 such that the securing element 104 may be introduced over the elongated support shaft 12 to engage the connection feature 106. In some embodiments, the securing element 104 includes threads configured to engage the threaded connection of the connection feature 106. In these and other embodiments, the securing element 104 may include a profile or other feature configured to engage or fit over the center column 58 to secure a position of the securing element 104 relative to the center column 58.

Referring now to FIG. 20, in some embodiments, the distal end 12D of the elongated support shaft 12 may include an ancillary stabilizing feature 108 to support the elongated support shaft 12 in the upright position when the elongated support shaft 12 and the anchoring container 14 are in an assembled configuration, as shown in FIG. 21. In one embodiment, the ancillary stabilizing feature 108 includes one or more projections or feet to stabilize a position of the distal end 12D relative to an inside surface of the anchoring container 14 or center column 58. In one embodiment, the projections of the ancillary stabilizing feature 108 extend into each of the gussets 60 extending radially from the center column 58, thereby preventing rotational and/or lateral movement of the elongated support shaft 12 relative to the anchoring container 14. The ancillary stabilizing feature 108 may also facilitate maintaining the elongated support shaft 12 in a secure upright position relative to the anchoring container 14.

Figure 22:
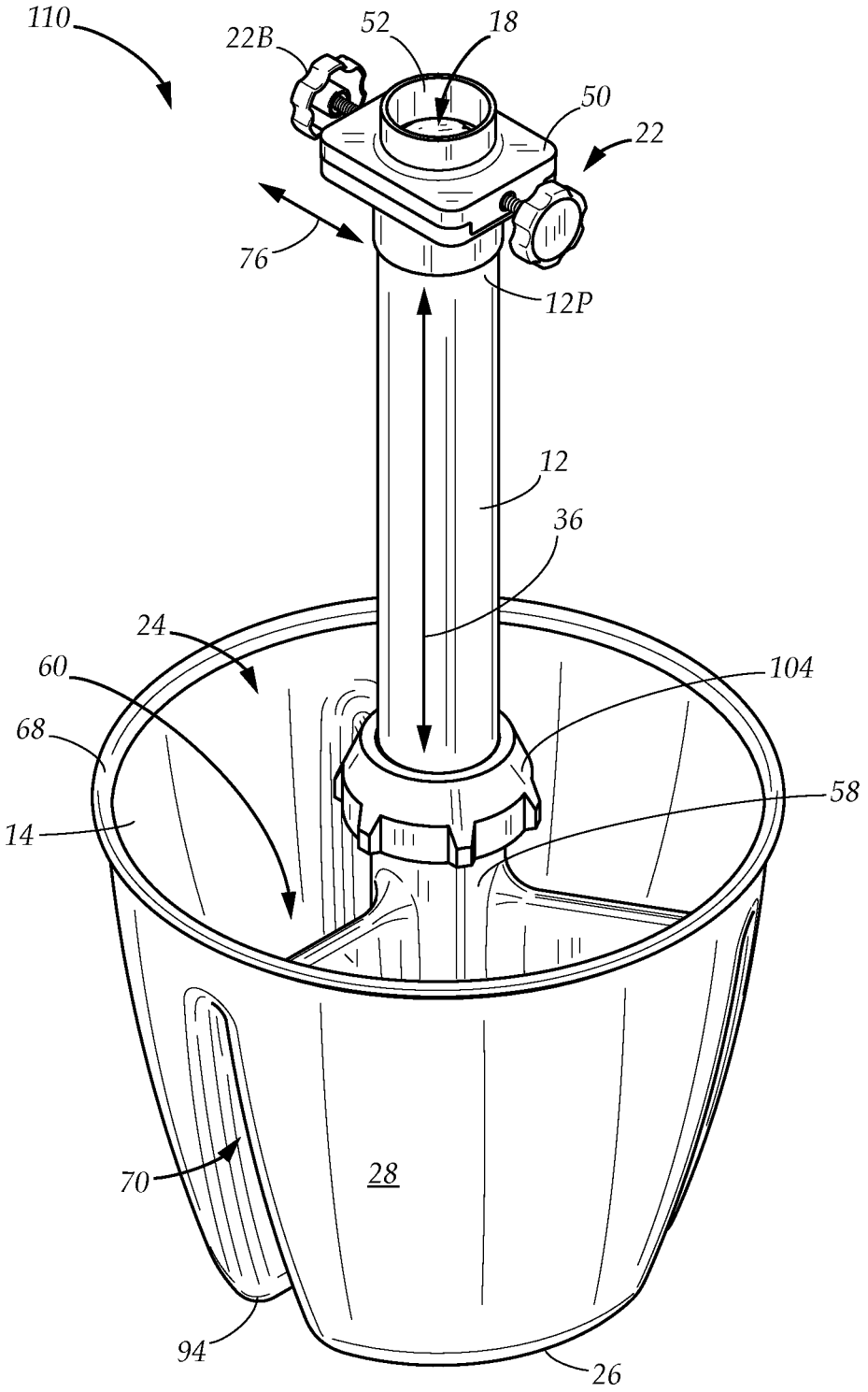
FIG. 22 is a perspective view of another embodiment of a beach umbrella anchoring and stabilizing system assembled in accordance with one embodiment of the disclosure.

Referring now to FIGS. 21 and 22, in some embodiments, the anchoring container 14 includes an open top 24 having an upper perimeter edge 68 circumscribing the center column 58. The anchoring container 14 may further include a closed bottom 26 defining a substantially planar surface 94. At least one sidewall 28 may extend between the upper perimeter edge 68 and the closed bottom 26 in a direction substantially parallel to the longitudinal axis 36 in an assembled configuration. In some embodiments, multiple gussets 60 extend radially between the elongated support shaft 12 and the sidewall 28. As illustrated in FIG. 15, a width of each of the gussets 60 may extend in a perpendicular direction relative to the longitudinal axis 36. In some embodiments, a height of each of the gussets 60 extends upward from the closed bottom 26 in a proximal direction parallel to the longitudinal axis 36.

Figure 23:
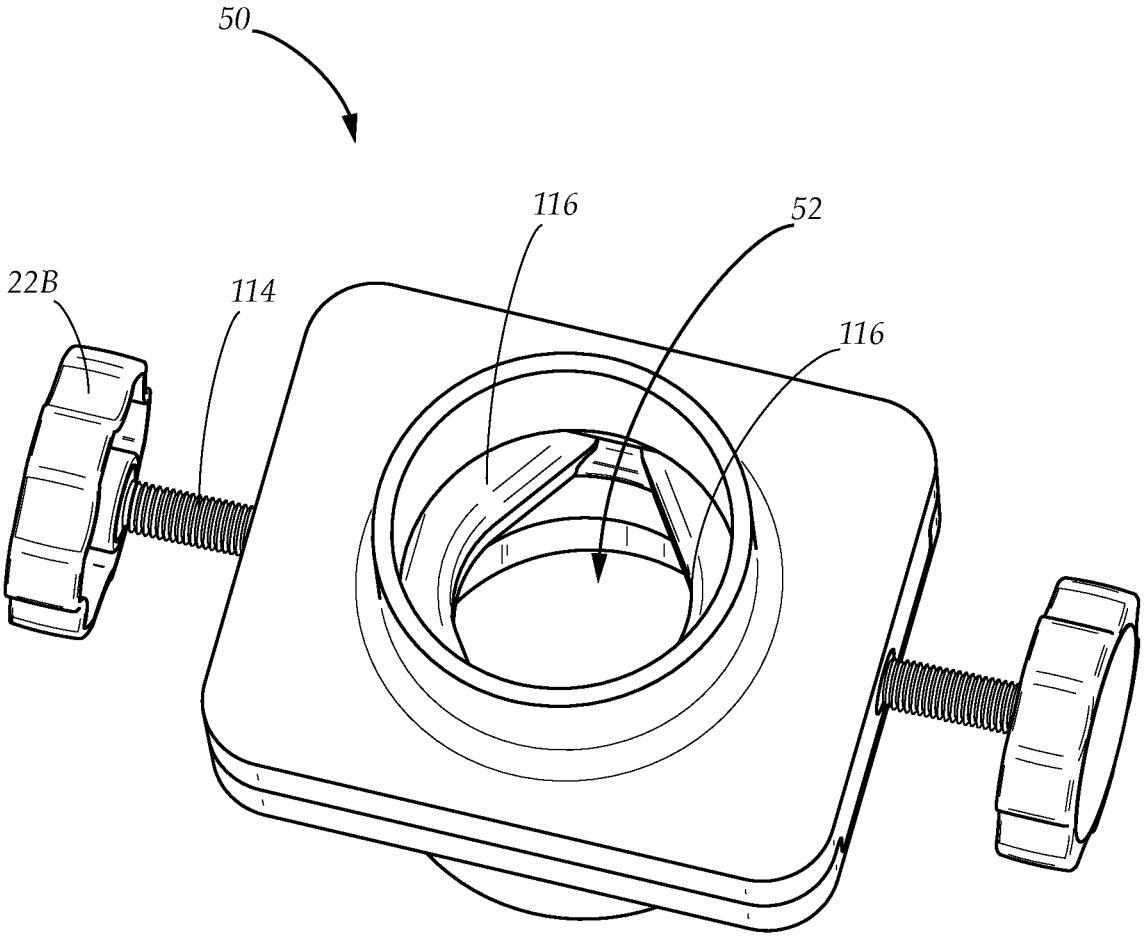
FIG. 23 is an enlarged perspective view of the collar component of the beach umbrella anchoring and stabilizing system of FIG. 22 in accordance with one embodiment of the present disclosure.

Referring now to FIG. 23 while still referring to FIGS. 20, 21, and 22, in some embodiments, the collar 50 is configured to couple to a proximal end 12P of the elongated support shaft 12. The collar 50 may couple to the elongated support shaft 12 via a threaded connection, a press fit, one or more mechanical fasteners, and/or the like. In some embodiments, the collar 50 includes a hole 52 52 corresponding to the hollow interior 18 of the elongated support shaft 12. One or more pressure elements 114 may hole 52 coupled to the collar 50 and may communicate with the hole 52 52 to selectively apply pressure to the beach umbrella support post 40 (shown in FIG. 18) to secure its position relative thereto.

In certain embodiments, as shown in FIGS. 20 and 21, the hole 52 includes an inner circumference 56. An actuator 74 may be coupled to the collar 50 and configured to selectively reduce the inner circumference 56 of the hole 52 to secure a position of the beach umbrella support post 40 (shown in FIG. 18) relative thereto.

In other embodiments, as shown in FIGS. 22 and 23 while also referring to FIG. 18, the collar 50 includes opposing pressure elements 114 extending in opposing perpendicular directions therethrough such that the pressure elements 114 engage the beach umbrella support post 40 via the hole 52. In one embodiment, the opposing pressure elements 114 include screws, posts, and/or other suitable mechanical elements to apply pressure to the beach umbrella support post 40 through the hole 52. In some embodiments, the pressure element 114 is coupled to a rigid, resilient, or flexible bar 116, ring, or other suitable element configured to contact the beach umbrella support post 40 through the hole 52. Extending at least one pressure element 114 in a perpendicular direction through the hole 52 may apply pressure and/or other forces to the beach umbrella support post 40 via the bar 116. In certain embodiments, one end of the pressure element 114 is coupled to a hand knob 22B or other suitable mechanism to facilitate extending the pressure element 114 with respect to the collar 50 and/or hole 52.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly. The term "substantially" is defined as at least 95% of the term being described and/or within a tolerance level known in the art and/or within 5% thereof.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a beach umbrella anchoring and stabilizing device. The disclosure is illustrated by example in the drawing figures, and throughout the written description. It should be understood that numerous variations are possible, while adhering to the inventive concept. Such variations are contemplated as being a part of the present disclosure.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A beach umbrella anchoring and stabilizing device configured to stabilize a beach umbrella with respect to an anchoring surface, comprising:

an elongated support shaft extending along a longitudinal axis between a proximal end and a distal end, wherein the elongated support shaft comprises a hollow interior configured to receive at least a portion of a beach umbrella support post;

an anchoring container coupled to the elongated support shaft, the anchoring container comprising an open top having an upper perimeter edge substantially surrounding at least a portion of the elongated support shaft and a closed bottom proximal to the distal end, the anchoring container further comprising at least one sidewall extending around the elongated support shaft between the open top and the closed bottom, the at least one sidewall defining a reservoir configured to receive a volume of sand; and a plurality of hollow stabilizing vanes extending radially from the elongated support shaft between the closed bottom of the anchoring container and the elongated support shaft, each of the plurality of hollow stabilizing vanes defining an interior trough in the closed bottom of the anchoring container configured to receive a portion of the volume of sand and an exterior surface protruding outwardly from the closed bottom of the anchoring container configured to engage a surrounding volume of sand.

2. The beach umbrella anchoring and stabilizing device of claim 1, wherein the proximal end of the elongated support shaft is disposed proximal to the upper perimeter edge of the anchoring container.

3. The beach umbrella anchoring and stabilizing device of claim 1, wherein the plurality of hollow stabilizing vanes are spaced at equal intervals around the elongated support shaft.

4. The beach umbrella anchoring and stabilizing device of claim 1, wherein each of the plurality of hollow stabilizing vanes extend in a distal direction between at least a portion of the at least one sidewall and the distal end of the elongated support shaft.

5. The beach umbrella anchoring and stabilizing device of claim 1, wherein the interior troughs include an elongate arcuate shape having a depth that tapers from the distal end of the elongated support shaft toward the at least one sidewall.

6. The beach umbrella anchoring and stabilizing device of claim 1, wherein the interior troughs include an elongate arcuate shape having a depth that tapers from the distal end of the elongated support shaft toward the closed bottom.

* * * * *